United States Patent [19]

Ohmatsu et al.

[11] Patent Number: 4,839,272

[45] Date of Patent: Jun. 13, 1989

[54] HEAT-DEVELOPABLE PHOTOSENSITIVE MATERIAL

[75] Inventors: Hideki Ohmatsu; Hiroyuki Hirai, both of Kanagawa, Japan

[73] Assignee: Fuji Photo Film Co., Ltd., Kanagawa, Japan

[21] Appl. No.: 30,647

[22] Filed: Mar. 27, 1987

[30] Foreign Application Priority Data

Mar. 28, 1986 [JP] Japan ..... 61-70056

[51] Int. Cl.[4] ..... G03C 1/50

[52] U.S. Cl. ..... 430/617; 430/203; 430/351; 430/567; 430/619; 430/620

[58] Field of Search ..... 430/617, 619, 620, 553, 430/351

[56] References Cited

U.S. PATENT DOCUMENTS 3,737,316 6/1973 Salminen et al. ..... 430/553
4,021,240 5/1977 Cerquone et al. ..... 430/351
4,525,451 6/1985 Ohki et al. ..... 430/553

FOREIGN PATENT DOCUMENTS 2156091 10/1985 United Kingdom .

*Primary Examiner*—Paul R. Michl
*Assistant Examiner*—Mark R. Buscher
*Attorney, Agent, or Firm*—Sughrue, Mion, Zinn, Macpeak & Seas

[57] ABSTRACT

A heat-developable photosensitive material comprising (1) a silver halide emulsion, (2) a reducing agent, and (3) a binder on a support can be quickly heat developed to produce images having a high density and less fog by using the silver halide emulsion comprising an emulsion of silver halide grains having a distinct double-layered structure, that is, core/shell structure in the grain interior and an average grain size of at least 0.3 μm in combination with (4) a specific compound of formula (I) or (II).

10 Claims, 1 Drawing Sheet

HEAT-DEVELOPABLE PHOTOSENSITIVE MATERIAL

BACKGROUND OF THE INVENTION

This invention relates to novel heat-developable photosensitive materials, and more particularly, to novel heat-developable photosensitive materials having high sensitivity and improved image density and exhibiting less fog upon heat development.

Heat developable photosensitive materials and their image forming processes are well known in the art and described in the literature, inter alia, "Fundamentals of Photographic Engineering —Non-Silver Salt Photography—", Corona Publishing K.K., Tokyo, Japan (1982), pages 242–255; "Image Information", Apr. 1978, page 40; and Nebletts Handbook of Photography and Reprography, 7th ed., Van Nostrand Reinhold Company, pages 32–33; U.S. Pat. Nos. 3,152,904, 3,301,678, 3,392,020, and 3,457,075; British Pat. Nos. 1,131,108 and 1,167,777; and Research Disclosure, June 1978, pages 9–15 (RD 17029).

A number of methods have been proposed for producing color images through heat development. For example, a process for forming color images through reaction of an oxidant of a developing agent with a coupler is known from U.S. Pat. Nos. 3,531,286, 3,761,270, and 4,021,240, Belgian Pat. No. 802,519, and Research Disclosure, September 1975, pages 31–32.

Formation of a positive color image by a photosensitive silver dye bleaching process is described in, for example, Research Disclosure, April 1976, pages 30–32 (RD-14433), ibid, December 1976, pages 14–15 (RD-15227), and U.S. Pat. No. 4,235,957.

Additionally, a process comprising imagewise releasing a mobile dye by heating and transferring the dye to a dye-fixing layer containing a mordant through a medium such as water, transfer to a dye-fixing material with the aid of a high boiling organic solvent, transfer to a dye-fixing material with the aid of a hydrophilic thermal solvent contained in the dye-fixing material, and transfer of a thermally diffusible or sublimatable mobile dye to a dye receiving material on a support were proposed as disclosed in the following patents:

| U.S. Pat. Nos. | | |
|---|---|---|
| 4,463,079 | 4,474,867 | 4,478,927 |
| 4,483,914 | 4,500,626 | 4,507,380 |
| Japanese Patent Application Kokai Nos. | | |
| 58-149046 | 58-149047 | 59-152440 |
| 59-154445 | 59-165054 | 59-168439 |
| 59-174832 | 59-174833 | 59-174834 |
| 59-174835 | 59-180548 | 59-218443 |

Japanese Patent Application No. 60–79709.

A wide variety of silver halide emulsions are known as useful in heat development.

The silver halide emulsions for heat development are deemed to be of a different design from conventional silver halide emulsions subject to wet processing because heat development proceeds as physical development. Although silver halide emulsions that can form a latent image serving as a physical development nucleus seem useful in this sense, no explicit directions have been determined on the design of silver halide emulsions for heat development.

There have been available no silver halide emulsions for heat development that are characterized by a high sensitivity, a minimized range of sensitivity varying with temperature and humidity during exposure, a minimized range of sensitization or desensitization by pressure, minimized latent image fading, and minimized photographic variation during shelf storage.

In general, the development of heat-developable photosensitive materials employs an auxiliary developing agent which functions to accelerate development as by mediating reaction between silver halide and a primary developing agent. Commonly used examples of the known auxiliary developing agents include hydroquinone, alkyl-substitutued hydroquinones such as t-butylhydroquinone and 2,5-dimethylhydroquinone, catechols, pyrogallols, halogen-substituted hydroquinones such as chlorohydroquinone and dichlorohydroquinone, alkoxy-substituted hydroquinones such as methoxyhydroquinone, and polyhydroxybenzene derivatives such as methylhydroxynaphthalene. Also effective are methyl oleate, ascorbic acid, ascorbic acid derivatives, hydroxylamines such as N, N'-di-(2-ethyoxyethyl)hydroxylamine, pyrazolidones such as 1-phenyl-3-pyrazolidone, 4-methyl-4-hydroxymethyl-1-phenyl-3-pyrazolidone, reductones, and hydroxytetronic acids.

Most of these auxiliary developing agents, however, are not regarded as having a sufficient development accelerating effect. Some auxiliary developing agents suffer from a problem of increasing fog, irrespective of some development accelerating effect.

Besides, heat development often experiences fogging which is unexpectable from the conventional wet development or processing with developing solution. A variety of fog inhibiting techniques have been proposed to control such fogging. For example, although U.S. Pat. No. 3,589,903 described that mercury compounds are effective in suppressing fogging under heat development, the use of the compounds toxic to the human body is undesired. Japanese Patent Application Kokai No. 60–198540 describes certain hydroquinone derivatives and 2,4-disulfonamidephenol derivatives, which are less satisfactory in fog inhibiting effect and tend to desensitize high sensitivity silver halide emulsions.

SUMMARY OF THE INVENTION

Therefore, an object of the present invention is to provide a novel and improved heat-developable photosensitive material which can produce a dye image having a high density with a high sensitivity and minimized fogging through heat development within a short time while maintaining other excellent photographic properties.

The present invention is directed to a heat-developable photosensitive material comprising at least a silver halide emulsion, a reducing agent for the silver halide emulsion, and a binder on a support. The feature of the present invention resides in that at least a portion of the silver halide emulsion is an emulsion of silver halide grains having a distinct double-layered structure in the grain interior and an average grain size of at least 0.3 μm, and the photosensitive material further comprises at least one member selected from the group consisting of compounds having the general formulas (I) and (II):

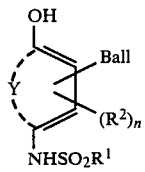

(I)

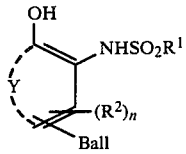

(II)

wherein Ball represents an organic ballast radical capable of rendering the compounds of these formulas non-diffusible, with the proviso that Ball may be absent when $R^1$ is a non-diffusible radical;

Y represents a group of carbon atoms necessary to complete a benzene or naphthalene nucleus;

$R^1$ is selected from the group consisting of a substituted or unsubstituted alkyl, cycloalkyl, aralkyl, aryl, amino, and heterocyclic radical;

$R^2$ is selected from the group consisting of hydrogen, a halogen atom, a substituted or unsubstituted alkyl, cycloalkyl, aralkyl, aryl, heterocyclic, alkoxy, aryloxy, acyl, alkyloxycarbonyl, aryloxycarbonyl, carbamoyl, sulfamoyl, alkylsulfonyl, arylsulfonyl, acylamino, alkylthio, and arylthio radical; and n is an integer having a value of 0 to 5;

wherein when n is 2 to 5, a corresponding plurality of $R^2$ may be the same or different and may be combined together to form a ring, and when Y represents a group of carbon atoms necessary to complete a naphthalene nucleus, Ball and $R^2$ may be attached to either of the thus formed rings.

BRIEF DESCRIPTION OF THE DRAWINGS

The only drawing.

DETAILED DESCRIPTION OF THE INVENTION

Figure 1:
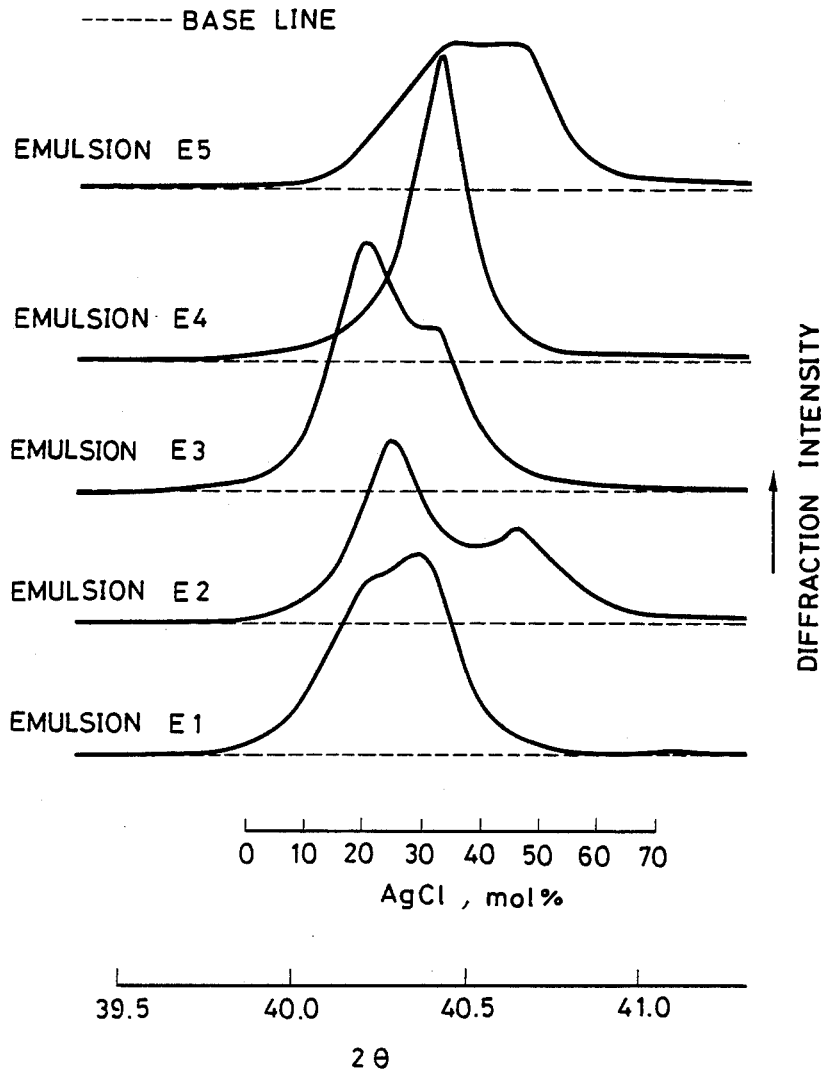
FIG. 1 is a diagram showing the diffraction intensity of grains in various silver halide emulsions prepared in Example 1 as a function of a diffraction angle $2\theta$.

The heat-developable photosensitive material of the present invention comprises an emulsion of silver halide grains having distinct double-layered structure in the grain interior and an average grain size of at least 0.3 μm, more preferably 0.3 to 3 μm as a silver halide emulsion. As used herein, the silver halide emulsion having a distinct double-layered structure is also referred to as a core/shell type emulsion.

The composition of the core/shell type emulsion is not particularly limited although compositions predominantly comprising silver bromide and having an iodine content of 20 mol % or less and a chlorine content of 50 mol % or less are preferred. The change of halogen composition of a grain in a depth direction, more exactly in a radial direction may be given as a change of chlorine, bromine or iodine concentration as long as a distinct layer structure appears in the grain. Also contemplated is a change of combined halogen concentration, for example, concentration of chlorine and bromine. Useful in the practice of the present invention are core/shell type emulsions having a layer structure as defined below. The term shell used herein corresponds to an outermost circumferentially extending portion of a grain and the term core corresponds to a relatively radially inner portion of the grain.

(1) Emulsions of core/shell type grains comprising a core of silver halide containing 10 to 45 mol % of silver iodide and a shell of silver halide containing 10 mol % or less of silver iodide or free of silver iodide.

(2) Emulsions of core/shell type grains of silver chlorobromide comprising a core and a shell having different ratios of silver bromide to silver chloride (up to 5 mol % of silver iodide may be contained).

(3) Emulsions of core/shell type grains comprising a shell having an iodine content of 5 to 40 mol % based on the total silver halides and a core having a lower iodine content.

Core/shell type silver halide emulsions as described in Japanese Patent Application Kokai Nos. 59-48755, 59-140444, 60-138538, 60-143331, and 60-254032 may also be employed, with good results.

Preferably in the practice of the present invention, the core/shell type emulsion is used in an amount of at least 40%, more preferably at least 50% of the overall silver halide emulsion calculated as silver weight.

As described above, the core/shell type emulsion has a layer structure which can be determined by X-ray diffractometry.

Application of X-ray diffractometry to silver halide grains is described in the literature, for example, H. Hirsch, Journal of Photographic Science, Vol. 10 (1962), page 129 ff. The lattice constant is determined by a particular halide composition and a peak of diffraction appears at a diffraction angle meeting the Bragg's law ($2d\sin\theta=\lambda n$). As to the X-ray diffractometry, reference may be made to "Basic Analytical Chemistry Series 24, "X-ray Analysis", Kyoritsu Shuppan K.K. and "A Guide to X-Ray Diffraction", Rigaku Denki K.K. The standard measurement uses a copper target and determines a diffraction pattern on (220) face of silver halide using Kβ ray of Cu as a radiation source (x-ray tube voltage 40 KV, tube current 60 mA). To increase the resolving power of the diffractometer, the width of slits (divergent slit, receiving slit, etc.), the time constant of the meter, the scanning rate of the goniometer, and recording speed are properly selected. A reference sample of silicon or the like is used to ascertain measurement accuracy.

When emulsion grains possess a structure having substantially two distinct layers, the maximum diffraction due to silver halide in a high bromine content layer and the minimum diffraction due to silver halide in a low bromine content layer appear, resulting in a diffraction curve having two peaks. It should be understood that these peaks need not be definite peaks and they may be shoulder-like peaks. The distinct double-layered structure as used herein is intended to means that preferably two peaks appear with a minimum interposed therebetween when a curve of diffraction intensity versus diffraction angle is determined on silver halide using Kβ ray of Cu at diffraction angles (2 ) in the range of 38° to 42°. However, the two peaks may be shoulder-like peaks rather than definite peaks as mentioned above. In such a case, each peak has a half-value width of greater than $\Delta 2°=0.25°$.

With an emulsion in which two types of grains each having no distinct layer structure, but having different halide compositions from each other are co-present, two peaks or shoulders also appears in an X-ray diffraction pattern. Such mixture-type emulsions cannot provide excellent photographic performance as achieved in the present invention.

To determine whether a silver halide emulsion is an emulsion having a distinct double-layered structure as defined in the present invention or an emulsion having silver halide grains of two different types co-present, X-ray diffractometry is further combined with electron probe X-ray microanalysis (EPMA). The EPMA process involves preparing a sample having emulsion grains fully dispersed to avoid mutual contact, irradiating the sample with an electron beam, and carrying out elemental analysis of an extremely minute portion by X-ray analysis assisted by electron radiation excitation. With this process, the halogen composition of each grain can be determined by measuring the intensity of X-rays characteristic of silver and bromine emitted by each grain.

Preparation of the core/shell type emulsion useful in the practice of the present invention will be described.

To ensure a distinct layer structure, the following considerations are useful.

(i) Core-forming silver halide grains are monodispersed and uniform to the maximum extent.

(ii) To achieve uniform coating, shell-forming silver halide is added at such a relatively high degree of supersaturation that the rate of growth of shell-forming silver halide is 30 to 100% of the critical crystal growth rate.

(iii) To provide a clear distinction between the halogen compositions of a core and a shell, the temperature at which shell-forming silver halide grows is equal to or lower than the core grain forming temperature.

(iv) The ratio of silver of core to shell ranges from 1/10 to 10. (v) During or after formation of core/shell silver halide grains, the halogen may be replaced by another halogen which forms more difficulty soluble silver halide grains. (vi) No particular limit is imposed on habit. Normal crystals are preferred rather than twin. Preferred crytals are of a cubin shape having (100) face on the outer surface, an octahedral shape having (111) face on the outer surface, or a tetradecagonal shape having (100) and (111) faces as expressed in Miller index.

In practice, a nitrogen-containing compound may be added during formation of core/shell silver halide grains as described in Japanese Patent Publication No. 46–7781, Japanese Patent Application No. 59–79160, and Japanese Patent Application Kokai No. 60–122935. It is also possible to add a spectral sensitizing dye during grain formation of the core/shell type silver halide emulsionnese Patent Application No. 59–79160, and Japanese Patent Application Kokai No. 60–122935. It is also possible to add a spectral sensitizing dye during grain formation of the core/shell type silver halide emulsion according to the present invention. The stage of addition may be before or after nucleus formation or before or after chemical sensitization. If the addition of a sensitizing dye before nucleus formation results in a widespread grain size distribution, it is desired to add the dye at stages after core grain formation.

The emulsion is generally removed of soluble salts after precipitation or physical ripening. Soluble salt removal means may be a traditional Nudel rinsing method using gelled gelatin or a flocculation method using an inorganic salt or a polyvalent anion (such as sodium sulfate), an anionic surface-active agent, an anionic polymer (such as polystyrene sulfonic acid), or a gelatin derivative (such as aliphatic acylated gelatin, aromatic acylated gelatin, and aromatic carbamoylated gelatin). The soluble salt removal step may be omitted.

As to other conditions, reference may be made to P. Galfkides, "Chimie et Physique Photographique", Paul Montel (1967), G.F. Duffin, "Photographic Emulsion Chemistry", The Focal Press (1966), and V.L. Zelikman et al., "Making and Coating Photographic Emulsion", The Focal Press (1964). More particularly, any methods including acid, neutral and ammonia methods may be used, and the mode of reaction of a soluble silver salt with a soluble halide salt may be single jet mixing, double jet mixing, and a combination thereof.

Also employable is a method of forming silver halide grains in the presence of excess silver ions, which is known as a reverse mixing method. One special type of double jet mixing method is by maintaining constant the pAg of a liquid phase in which a silver halide is formed, which is known as a controlled double jet method.

To accelerate grain growth, the concentration, amount and/or flow rate of silver salt and halide salt added may be increased as indicated in Japanese Patent Application Kokai Nos. 55-142329 and 55-158124 and U.S. Pat. No. 3,650,757.

During or after formation of silver halide grains, the surface of silver halide grains may be replaced by another halogen which forms more difficulty soluble silver halide grains.

Agitation of reaction solution may be conducted by any well-known agitation means. Also no particular limit is imposed on the temperature and pH of reaction solution during formation of silver halide grains.

A suitable silver halide solvent may be used at the stage of forming core/shell silver halide grains, for example, rhodanates, ammonia; the organic thioether derivatives described in Japanese Patent Publication No. 47–11386; and the sulfur-containing compounds described in Japanese Patent Application Kokai No. 53–144319.

In the step of forming or physically ripening silver halide grains, there may coexist a cadmium salt, zinc salt, lead salt, thallium salt or another salt.

For the purpose of improving high or low intensity reciprocity low failure, there may be used water-soluble iridium salts such as iridium (III, IV) chlorides and ammonium hexachloroiridate as well as water-soluble rhodium salts such as rhodium chloride.

A binder or protective colloid used in the preparation of the core/shell type emulsion according to the present invention or a binder for another hydrophilic colloid is advantageously gelatin although a hydrophilic colloid other than gelatin may be used. Examples include proteins such as gelatin, gelatin derivatives, graft polymers of gelatin with other polymers, albumin, and casein; cellulose derivatives such as hydroxyethylcellulose, carboxymethylcellulose, and cellulose sulfate; polysaccharides such as sodium alginate and starch derivatives; and various hydrophilic synthetic polymers, for example, homopolymers and copolymers of polyvinyl alcohol, partial acetal-polyvinyl alcohol, poly-Nvinylpyrolidone, polyacrylic acid, polymethacrylic acid, polyacrylamide, polyvinyl imidazole, and polyvinyl pyrazole.

The gelatins used include a lime-treated gelatin, an acid-treated gelatin, an enzyme-treated gelatin as described in Bull. Soc. Sci. Phot. Japan, No. 16 (1966), page 30, a gelatin hydrolyzate, and an enzymatically decomposed gelatin.

The core/shell type emulsion used herein is chemically sensitized. For chemical sensitization purpose, there may be used sulfur sensitization, reducing sensitization, selenium sensitization, noble metal sensitization, and other processes alone or in combination as described in H. Frieser, Die Grundlagen der Photographishen Prozesse mit Shilderhalogeniden, Akademische Verlagsgescellschaft, 1968, pages 675–734.

More particularly, sulfur sensitization uses a sulfur sensitizer, that is a sulfur compound capable of reacting with active gelatin or silver, for example, thiosulfates, allythiocarbamide, thiourea, allylisothiocyanate, cystine, p-toluenethiosulfonates, rhodan, and mercapto compounds. Other sulfur compounds used herein are described in U.S. Pat. Nos. 1,574,944, 2,410,689, 2,278,947, 2,728,668, and 3,656,955.

The amount of the sulfur sensitizer added varies over a wide range under various conditions although it preferably ranges from about $10^{-7}$ to $10^{-2}$ mol per mol of silver.

Gold sensitization uses a gold sensitizer whose gold may have an oxidation number of +1 or +3. Examples include chloroaurates such as potassium chloroaurate, auric trichloride, potassium auric thiocyanate, potassium iodaurate, and tetracyanoauric acid.

The amount of the gold sensitizer added varies over a wider range under various conditions although it preferably ranges from about $10^{-9}$ to $10^{-2}$ mol per mol of silver.

Selenium sensitization may also be used in the practice of the present invention. Selenium sensitizers used herein include aliphatic isoselenocyanates such as allyl isoselenocyanate, selenoureas, selenoketones, selenoamides, selenocarboxylic acids and esters, selenophosphates, selenides such as dimethylselenide and diethylselenide. Illustrative examples are described in U.S. Pat. Nos. 1,574,944, 1,602,592, and 1,623,499.

The amount of the selenium sensitizer added varies over a wide range under various conditions although it preferably ranges from about $10^{-7}$ to $10^{-2}$ mol per mol of silver.

In combination with the above-mentioned sulfur, gold or selenium sensitization, a reducing sensitization process using a reducing compound (e.g. stannous salts, amines, hydroazines, formamidinesulfinic acid, silane compounds) and a noble metal sensitization process using a noble metal compound (e.g. complex salts of the metals of Groups VIII in the Periodic Table including Pr, Ir, and Pd as well as gold complex salts) may be used.

For the reducing sensitization, reference is made to U.S. Pat. Nos. 2,983,609, 2,419,974, and 4,054,458. For the noble metal sensitization, reference is made to U.S. Pat. Nos. 2,399,083 and 2,448,060 and British Pat. No. 618,061.

Typical combinations of sensitizers are gold/sulfur sensitization and gold/selenium sensitization although other combinations may be employed. For gold/sulfur sensitization, the ratio of the gold/sulfur sensitizers varies with ripening and other conditions although about 1 to 1000 mols of the sulfur sensitizer is usually used per mol of the gold sensitizer. For gold/selenium sensitization, about 1 to 1000 mols of the selenium sensitizer is usually used per mol of the gold sensitizer. In the gold/sulfur sensitization or gold/selenium sensitization, the gold sensitizer may be added either at the same time as the sulfur or selenium sensitizer or during or after sensitization with the sulfur or selenium sensitizer.

The preferred chemical sensitization used herein is sulfur sensitization or gold/sulfur sensitization.

In the practice of the present invention, the chemical sensitizer is added to the photographic silver halide emulsion according to a conventional procedure. More particularly, the sensitizers are added as aqueous solutions if they are water soluble compounds or as solutions in water-miscible organic solvents such as methanol and ethanol if they are organic solvent-soluble compounds.

The pH, pAg and temperature used during the chemical sensitization are not critical although the preferred pH value ranges from 4 to 9, more preferably from 5 to 8, and the preferred pAg ranges from 5 to 11, more preferably from 7 to 10. The temperature preferably ranges from 40 ° to 90°°C., more preferably from 45° to 75° C.

It is also well known to carry out chemnical sensitization in the presence of a nitrogenous heterocyclic compound. See British Pat. No. 1,315,755, Japanese Patent Application Kokai Nos. 50-63914, 51-77223, 58-126526, and 58-215644.

It is also useful to produce a less fogging silver halide emulsion by carrying out chemical sensitization in the presence of an acetylene compound as disclosed in Japanese Patent Publication Nos. 39–22067 and 39–22068.

In forming a photosensitive material using the emulsion as described above, a color sensitive layer may be formed by mixing different emulsions. It is also possible to form one color sensitive layer as a multi-layer structure by applying different emulsions having the same color sensitivity as separate layers, obtaining a photosensitive material.

To achieve the object of the present invention, the core/shell type silver halide emulsion as defined above is combined with at least one compound having the general formula (I) or (II):

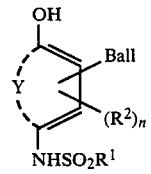

(I)

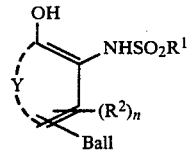

(II)

In formulas (I) and (II), $R^1$ is selected from a substituted or unsubstituted alkyl, cycloalkyl, aralkyl, aryl, amino, and heterocyclic radical. Preferred, nonlimiting examples of $R^1$ radicals include substituted or unsubstituted alkyl radicals having 1 to 30 carbon atoms, such as methyl, ethyl, and dodecyl; substitued or unsubstituted cycloalkyl radicals having 5 to 30 carbon atoms, such as cyclohexyl; substituted or unsubstituted aralkyl radicals having 7 to 30 carbon atoms, such as benzyl and β-phenethyl; substituted or unsubstituted aryl radicals having 6 to 30 carbon atoms, such as phenyl, naphthyl, tolyl, and xylyl; substituted or unsubstituted amino radicals having 0 to 30 carbon atoms, such as amino, methylamino, isopropylamino, cyclohexylamino, phenylamino, benzylamino, N,N-dimethylamino, N-methyl-N-ethylamino, N,N-diisopropylamino, N,N-dicyclohexylamino, N,N-diphenylamino, and N,N-dibenzylamino; and substituted or unsubstituted heterocyclic radicals such as pyridyl, furyl, and thienyl radicals.

The substituents on the aryl radicals represented by $R^1$ include halogen atoms (such as chloro and bromo), amino, alkoxy, aryloxy, hydroxyl, aryl, carbonamide, alkanoyloxy, benzoyloxy, ureido, carbamate, carbamoyloxy, carbonate, carboxy, alkyl (such as methyl, ethyl and propyl), acylamino, sulfamoyl, ester, alkylsulfonyl, alkylsulfonylamino, and arylsulfonylamino radicals.

$r^2$ represents hydrogen, halogen, a substituted or unsubstituted alkyl, cycloalkyl, aralkyl, aryl, heterocyclic, alkoxy, aryloxy, acyl, alkyloxycarbonyl, aryloxycarbonyl, carbamoyl, sulfamoyl, alkylsulfonyl, arylsulfonyl, acylamino, alkylthio, arylthio radical.

Preferred, non-limiting examples of $R^2$ radicals include hydrogen atoms; halogen atoms such as chloro and bromo; substituted or unsubstituted alkyl radicals having 1 to 20 carbon atoms, such as methyl, ethyl, isopropyl, and t-butyl; substituted or unsubstituted cycloalkyl radicals having 5 to 20 carbon atoms, such as cyclopentyl and cyclohexyl; substituted or unsubstituted aralkyl radicals having 7 to 20 carbon atoms, such as benzyl and $\beta$-phenetyl; substituted or unsubstituted aryl radicals having 6 to 20 carbon atoms, such as phenyl, naphthyl, tolyl, and xylyl; substituted or unsubstituted heterocyclic radicals such as pyridyl, furyl, and thienyl; substituted or unsubstituted alkoxy radicals having 1 to 20 carbon atoms, such as methoxy, butoxy, and methoxyethoxy; substituted or unsubstituted aryloxy radicals having 6 to 20 carbon atoms, such as phenoxy; substituted or unsubstituted acyl radicals having 1 to 20 carbon atoms, such as acetyl and palmitoyl; substituted or unsubstituted alkyloxycarbonyl radicals having 1 to 20 carbon atoms, such as methoxycarbonyl; substituted or unsubstituted aryloxycarbonyl radicals having 6 to 20 carbon atoms, such as phenoxycarbonyl; substituted or unsubstituted carbamoyl radicals having 1 to 20 carbon atoms, such as methylcarbamoyl, dimethylcarbamoyl, and diisopropylcarbamoyl; substituted or unsubstituted sulfamoyl radicals having 1 to 20 carbon atoms, such as dimethylsulfamoyl; substituted or unsubstituted alkylsulfonyl radicals having 1 to 20 carbon atoms, such as methylsulfonyl; substituted or unsubstituted arylsulfonyl radicals having 6 to 20 carbon atoms, such as phenylsulfonyl and pmethylphenylsulfonyl; substituted or unsubstituted acylamino radicals having 2 to 20 carbon atoms, such as acetylamino, N-methylacetylamino, and palmitoylamino; substituted or unsubstituted alkylthio radicals having 1 to 20 carbon atoms, such as methylthio and ethylthio; and substituted or unsubstituted arylthio radicals having 6 to 30 carbon atoms, such as phenylthio and m-methoxycarbonylphenylthio radicals.

The letter n is an integer having a value of 0 to 5. When n is 2 to 5, a corresponding plurality of $R^2$ may be the same or different. They may be combined together to form a ring. Examples of the ring formed by plural $R^2$ are cyclohexene and bicyclo[2.2.1]hept-2-ene fused to the benzene ring completed by Y as will be described later.

Ball represents an organic ballast radical capable of rendering the compounds of these formulas non-diffusible, with the proviso that Ball may be absent when $R^1$ is a non-diffusible radical.

The nature of the ballast radical represented by Ball is not critical insofar as the ballast radical imparts diffusion resistance to the associated compound. In general, the ballast radicals include straight chain or branched alkyl radicals directly or indirectly attached to the associated compound and aromatic radicals of benzene and naphthalene species directly or indirectly attached to the associated benzene nucleus. The useful ballast radicals contain at least 8 carbon atoms, and include, for example, alkyl radicals having 8 to 30 carbon atoms, acylamino radicals having 8 to 30 carbon atoms, acyl radicals having 8 to 30 carbon atoms, acyloxy radicals having 8 to 30 carbon atoms, alkoxy radical having 8 to 22 carbon atoms, alkylthio radicals having 8 to 30 carbon atoms, and alkoxy radicals, substituted with alkoxycarbonyl having 8 to 30 carbon atoms, with all these radicals being substituted or unsubstituted.

Examples of the indirectly attached ballast radicals are those attached through a carbamoyl or sulfamoyl radical as represented by the general formulae (A) and (B), the nitrogen atom of the carbamoyl or sulfamoyl radical being attached to the ballast radical.

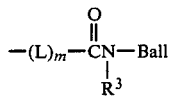
(A)

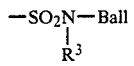
(B)

In formulae (A) and (B), $R^3$ is preferably hydrogen, an alkyl radical having 1 to 7 carbon atoms such as methyl and ethyl, a cycloalkyl radical such as cyclohexyl, or an aryl radical such as phenyl; L represents a divalent radical such as an alkylene radical, a phenylene radical, and a divalent arylthio radical; and m is equal to 0 or 1.

Y represents a group of carbon atoms necessary to complete a benzene or naphthalene nucleus. When Y represents a group of carbon atoms necessary to complete a naphthalene nucleus, Ball and $R^2$ may be attached to either of the thus formed rings.

Some preferred, but non-limiting, examples of the compounds having general formula (I) and (II) are given below.

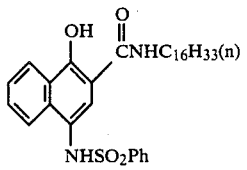
(1)

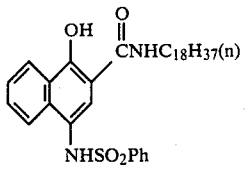
(2)

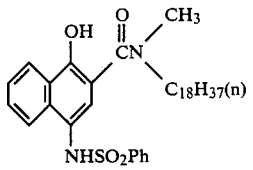
(3)

-continued
(4)
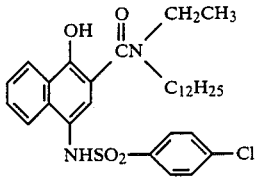
(5)
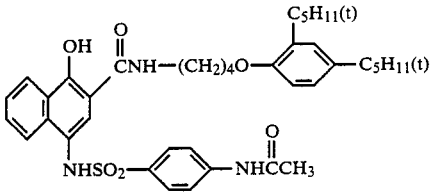
(6)
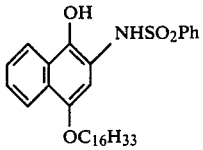
(7)
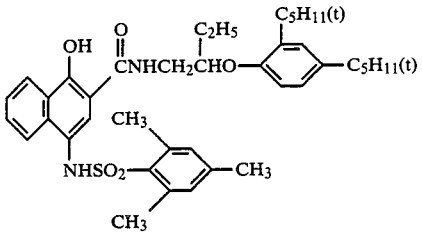
(8)
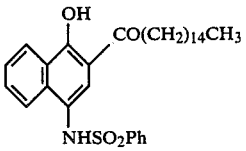
(9)
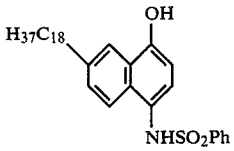
(10)
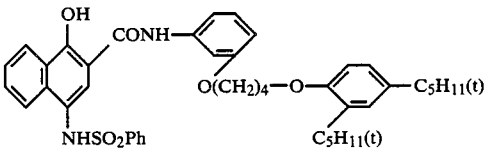
(11)
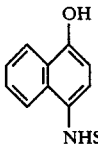
(12)
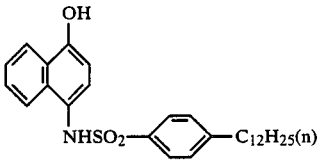
-continued
(13)
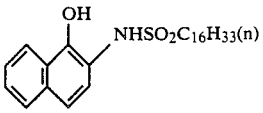
(14)
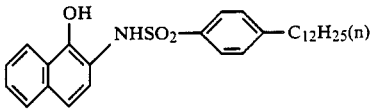
(15)
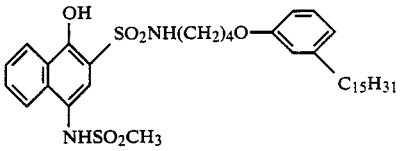
(16)
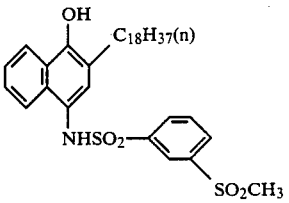
(17)
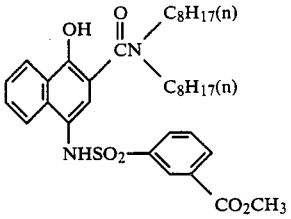
(18)
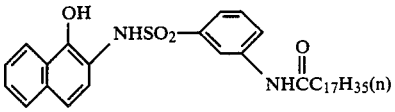
(19)
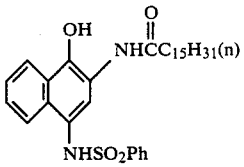
(20)
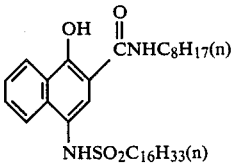
(21)
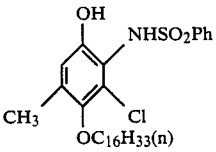
(22)
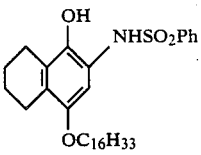

-continued
(23)
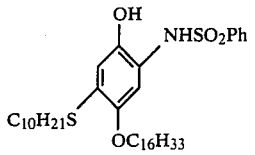
(24)
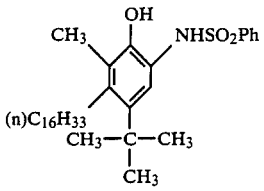
(25)
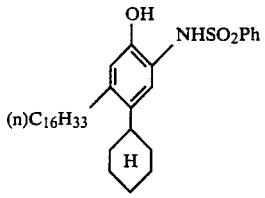
(26)
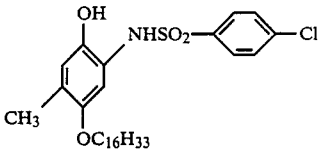
(27)
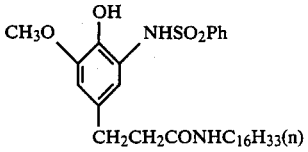
(28)
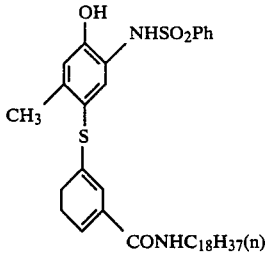
(29)
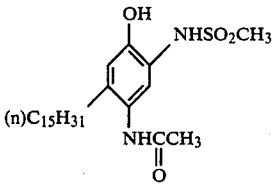
(30)
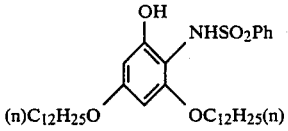
-continued
(31)
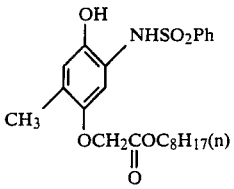
(32)
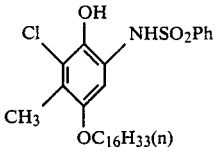
(33)
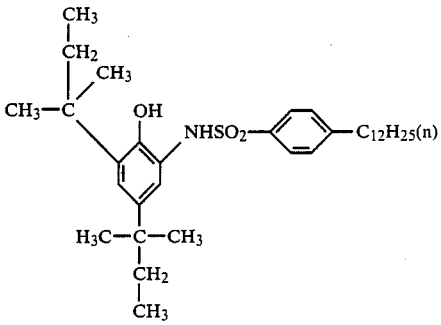
(34)
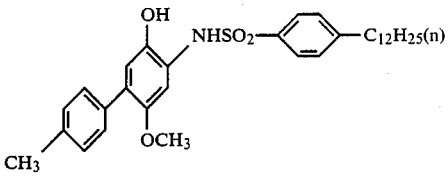
(35)
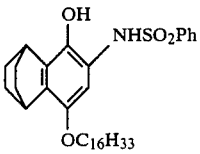
(36)
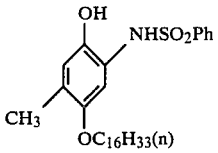
(37)
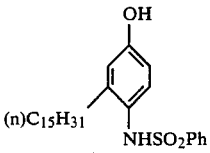
(38)
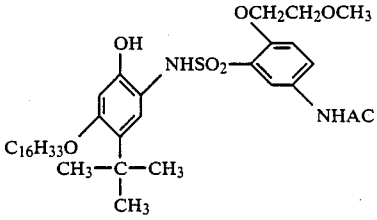

-continued
(39)
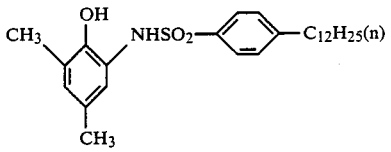
(40)
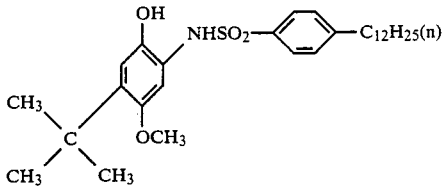
(41)
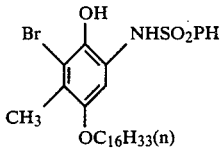
(42)
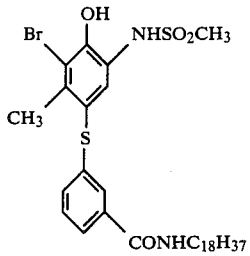
(43)
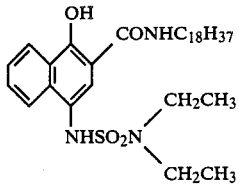
(44)
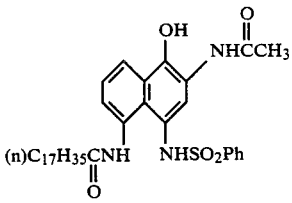
(45)
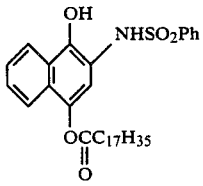
(46)
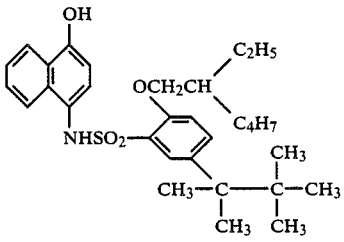
-continued
(47)
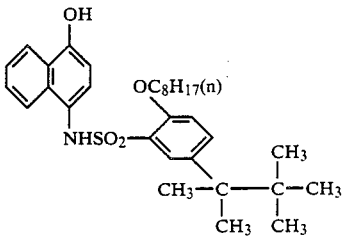
(48)
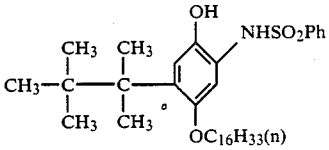
(49)
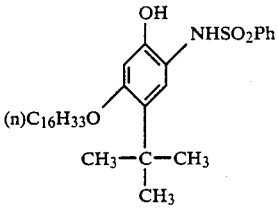
(50)
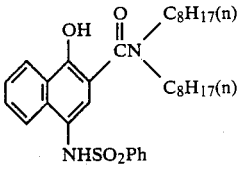
(51)
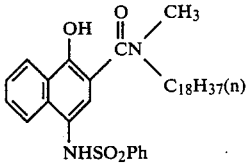
(52)
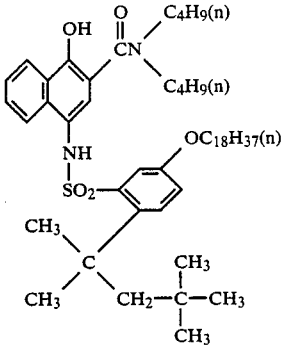
(53)
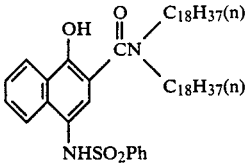
The compounds according to the present invention may be used alone or in admixture of two or more. They may be incorporated in any layers of photosensitive material including an emulsion layer, intermediate layer, and protective layer. Most advantageously, they are added to a dispersion of a dye-providing substance and incorporated in an emulsion layer.

The amount of the compound added is 0.0005 to 20 mols, preferably 0.001 to 4 mols per mol of silver.

The photographic emulsions used in the present invention may contain various compounds for the purposes of preventing fog and stabilizing photographic performance during preparation, shelf storage, and photographic processing of photosensitive materials. Typical are compounds known as antifoggants or stabilizers, for example, azoles such as benzothiazolium salts, nitroimidazoles, nitroenzimidazole, chlorobenzimidazoles, bromoimidazoles, mercaptothiazoles, mercaptobenzothiazoles, mercapotobenzimidazoles, mercaptothiadiazoles, aminotriazoles, benzotriazoles, nitrobenzotriazoles, mercaptotetrazoles (inter alia, 1-phenyl-5-mercaptotetrazole), etc.; mercaptopyrimidines; mercaptotriazines; thioketo compounds such as oxazolinethione; azaindenes such as triazaindenes, tetraazaindenes, especially 4-hydroxy substituted (1,3,3a,7-)tetraazaindenes, pentaazaindenes; benzenthiosulfonic acid, benzenesulfonic acid, benzenesulfonic acid amide, etc. Useful compounds are those described in U.S. Pat. Nos. 3,954,474 and 3,982,947 and Japanese Patent Publication No. 52-28660. The acetylene compounds described in Japanese Patent Publication Nos. 39-22067 and 39-22068 are also useful antifoggants. More illustrative of the acetylene compounds is Japanese Patent Application No. 59-193468.

To increase sensitivity, enhance contrast or accelerate development, the photosensitive material may contain, for example, polyalkylene oxides or their ether, ester, and amine derivatives, thioethers, thiomorpholines, quaternary ammonium salts, urethane derivatives, urea derivatives, imidazole derivatives, and 3-pyrazolidones. Useful compounds are disclosed in U.S. Pat. Nos. 2,400,532, 2,423,549, 2,716,062, 3,617,280, 3,772,021, and 3,808,003 and British Pat. No. 1,488,991.

The silver halide emulsions used in the practice of the present invention may be either of the surface latent image type wherein latent images are predominantly formed on the grain surface or of the internal latent image type wherein latent images are formed in the grain interior. A direct reversal emulsion is also employable having an internal latent image type emulsion combined with a nucleating agent. The internal latent image type emulsions suitable for the purpose are described in U.S. Pat. Nos. 2,592,250 and 3,761,276, Japanese Patent Publication No. 58-3534 and Japanese Patent Application Kokai No. 57-136641. Preferred examples of the nucleating agents combined with the emulsions are described in U.S. Pat. Nos. 3,227,552, 4,245,037, 4,255,511, 4,266,013 and 4,276,364 and OLS 2,635,316.

The silver halides used in the practice of the present invention may be spectrally sensitized with methine dyes and other dyes. The dyes useful for spectral sensitization include cyanine dyes, merocyanine dyes, complex cyanine dyes, complex merocyanine dyes, holopolar cyanine dyes, hemicyanine dyes, styryl dyes, and hemioxonal dyes. Particularly useful dyes among then are cyanine, merocyanine, and complex merocyanine dyes.

For these dyes, any nuclei generally utilized for cyanine dyes can be applied as basic heterocyclic ring nuclei. For example, applicable are pyrroline nuclei, oxazoline nuclei, thiazole nuclei, selenazole nuclei, imidazole nuclei, tetrazole nuclei, pyridine nuclei, etc.; and nuclei of the foregoing nuclei having cycloaliphatic hydrocarbon rings fused thereto and nuclei of the foregoing nuclei having aromatic hydrocarbon rings fused thereto, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. These nuclei may be substituted on carbon atoms.

For the merocyanine and complex merocyanine dyes, 5- or 6-membered heterocyclic nuclei are applicable as a nucleus having a ketomethylene structure, for example, a pyrazolin-5-one nucleus, thiohydantoin nucleus, 2-thiooxazolidine-2,4-dione nucleus, thiazolidine-2,4-dione nucleus, rhodanine nucleus, and thiobarbituric acid nucleus.

Illustrative examples are the sensitizing dyes disclosed in Japanese Patent Application Kokai Nos. 59-180550 and 60-140335 and Research Disclosure, June 1978, pages 12–13 (RD 17029); and the sensitizing dyes disclosed in the following U.S. Patents;

| | | |
|---|---|---|
| 1,846,300 | 2,078,233 | 2,089,129 |
| 2,165,338 | 2,231,658 | 2,295,276 |
| 2,481,698 | 2,688,545 | 2,917,516 |
| 2,921,067 | 3,282,933 | 3,335,010 |
| 3,352,680 | 3,352,857 | 3,384,486 |
| 3,397,060 | 3,411,916 | 3,623,881 |
| 3,660,103 | 3,718,470 | 4,025,349 |

Heat decoloring dyes are described in Japanese Patent Application Kokai No. 60-111239 and Japanese Patent Application No. 60-172967.

The sensitizing dyes may be used alone or in combination. Combinations of sensitizing dyes are often used particularly for the purpose of supersensitization (see U.S. Pat. Nos. 3,506,443 and 3,672,898).

Along with the sensitizing dyes, the emulsions may contain dyes which themselves have no spectral sensitization effect or substances which do not substantially absorb visible light, but have the nature of supersensitization. Useful are aminostyrul compounds having a nitrogenous heterocyclic substituent as described in U.S. Pat. Nos. 2,933,390 and 3,635,721, aromatic organic acid-formaldehyde condensates as described in U.S. Pat. No. 3,743,510, cadmium salts and azaindenes. Particularly useful combinations are described in U.S. Pat. Nos. 3,615,613, 3,615,641, 3,617,295 and 3,635,721.

The sensitizing dyes may be incorporated into the photographic silver halide emulsion by directly dispersing the dyes in the emulsion, or dissolving the dyes in a solvent such as water, methanol, ethanol, acetone and methyl cellosolve or a solvent mixture before being added to the emulsion. Alternatively, the dyes may be dissolved in a solvent substantially immiscible with water such as phenoxyethanol and then dispersed in water or hydrophilic colloid to form a dispersion which is added to the emulsion. It is also possible to mix the sensitizing dyes with a oleophilic substance such as a dye-providing substance and to add the mixture to the emulsion. In dissolving sensitizing dyes of a particular combination, they may be separately dissolved or a mixture may be dissolved. In adding sensitizing dyes to the emulsion, they may be added to the emulsion simultaneously as a mixture or separately or at the same time as another additive. These sensitizing dyes may be added to the emulsion during, before or after chemical ripening, or before or after nucleation of silver halide grains according to the teachingss of U.S. Pat. Nos. 4,183,756 and 4,225,666.

The amount of the sensitizing dye is generally from $10^{-8}$ to $10^{-2}$ mol per mol of the silver halide.

The amount of the photosensitive silver halide coated preferably ranges from 1 mg to 10 g of silver per square meter.

In the practice of the present invention, an organic metal salt which is relatively stable to light may be used as an oxidizing agent in combination with the photosensitive silver halide. It is necessary that the photosensitive silver halide and the organic metal salt be in contact with or close to each other. Preferred organic metal salts are organic silver salts. These organic metal salts are effective when the heat-developable photosensitive material is developed by heating at a temperature of at least 50° C., preferably at least 60° C.

The organic compounds which can be used in the preparation of the organic silver salt oxidizing agents include aliphatic and aromatic carboxylic acids, compounds containing a mercapto group or a thiocarbonyl group having α-hydrogen, and compounds containing an imino group.

Typical examples of the aliphatic carboyxlic acid silver salts include silver salts derived from behenic, stearic, oleic, lauric, capric, myristic, palmitic, maleic, fumaric, tartaric, furoinic, linolic, linolenic, adipic, sebasic, succinic, acetic, lactic, propiolic, and camphoric acids. Also employable are silver salts derived from halogen or hydrogen substituted products of these aliphatic acids and silver salts derived from aliphalic carboxylic acids having a thioether group.

Typical example of the silver salts of aromatic carboxylic acids and other carboxy-containing compounds include silver salts derived from benzoic, 3,5-dihydroxybenzoic, o-, m- and p-methylbenzoic, 2,4-dichlorobenzoic, acetamidebenzoic, p-phenylbenzoic, gallic, tannic, phthalic, terephthalic, salicyclic, phenylacetic, and pyromellitic acids, and 3-carboxymethyl-4-methyl-4-thiazoline-2-thione.

Typical examples of the compounds containing a mercapto group or a thiocarbonyl group include silver salts derived from 3-mercapto-4-phenyl-1,2,4-triazole, 2-mercaptobenzimidazole, 2-mercapto-5-aminothiadiazole, 2-mercaptobenzothiazole, S-alkylthioglycolic acids having an alkyl radical containing 12 to 22 carbon atoms, dithiocarboxylic acids such as dithioacetic acid, thioamides such as thiostearamide, 5-carboxy-1-methyl-2-phenyl-4-thiopyridine, mercaptotriazine, 2-mercaptobenzoxazole, mercaptooxadiazole and 3-amino-5-benzylthio-1,2,4-triazole, and other mercapto compounds as disclosed in U.S. Pat. No. 4,123,274.

Typical examples of the compounds containing an imino group include silver salts derived from benzotriazole and its derivatives, for example, benzotriazole, alkylsubstituted benzotriazoles such as methylbenzotriazole, halo-substituted benzotraizoles such as 5-chlorobenzotriazole, carboimidobenzotriazoles such as butylcarboimidobenzotriazole as described in Japanese Patent Publication Nos. 44-30270 and 45-18416; nitrobenzotriazoles as described in Japanese Patent Application Kokai No. 58-118639; sulfobenzotriazoles, carboxybenzotriazoles or salts thereof and hydroxybenzotriazoles as described in Japanese Patent Application Kokai No. 58-118638; and 1,2,4-triazoles, 1H-tetrazole, carbazoles, saccharin, imidazoles and derivatives thereof as described in U.S. Pat. No. 4,220,709.

Also useful in the practice of the present invention are silver salts and organic metal salts other than silver salts such as copper stearate as described in Research Disclosure, June 1978 (RD-17029) and silver salts of carboxylic acids having an alkyl radical such as phenylpropiolic acid as described in Japanese Patent Application No. 58-221535.

These organic silver salts may be used in amounts of from 0.01 to 10 mols, preferably from 0.01 to 1 mol per mol of the photosensitive silver halide. The combined amount of the photosensitive silver halide and the organic silver salt coated suitably ranges from about 50 $mg/m^2$ to 10 $g/m^2$ calculated as silver.

In the practice of the present invention, silver may be used as an image-forming material. Also, there may be contained a compound which, when the photosensitive silver halide or silver ion is reduced into silver at elevated temperatures, produces or releases a mobile or diffusible dye in direct or inverse proportion to the reaction. These compounds are simply referred to as dye-providing substances hereinafter.

Typical of the dye-providing substances which can be used in the present invention are couplers capable of reaction with developing agents. In the system using a coupler, a silver salt and a developing agent make a redox reaction to form an oxidant of the developing agent which in turn, reacts with the coupler to form a dye. Illustrative examples of the developing agents and couplers are described in detail in, for example, T.H. James, "The Theory of the Photographic Process", 4th Ed., pages 291–334 and 354–361, and the following laid-open specifications.

Japanese Patent Application Kokai Nos.

| | | |
|---|---|---|
| 58-123533 | 58-149046 | 58-149047 |
| 59-111148 | 59-124339 | 59-174835 |
| 59-231539 | 59-231540 | 60-2950 |
| 60-2951 | 60-14242 | 60-23474 |
| 60-66249. | | |

The dye-provicing substances employably other than the aforementioned include dye-silver compounds in which an organic silver salt is combined with a dye. Examples of the dye-silver compounds are described in Research Disclosure, May 1978, pages 54–58 (RD-16966). Also included are azo dyes useful in heat development silver dye bleaching process. Examples of the azo dyes and bleaching process are described in U.S. Pat. No. 4,235,957 and Research Disclosure, April 1976, pages 30–32 (RD-14433). A further example of the dye-providing substance is leuco dyes as described in U.S. Pat. Nos. 3,985,565 and 4,022,617.

Another class of dye-providing substances includes compounds having the function of releasing or diffusing a diffusible dye imagewise. The compounds of this type may be represented by the following formula [L I]:

$$(\text{Dye-X})_x - \text{Y} \qquad [\text{L I}]$$

wherein Dye represents a dye group, a temporarily wavelength shortened dye group or a dye precursor group; X represents a single bond or a connecting linkage; and Y represents a group which, in correspondence or counter-correspondence to photosensitive silver salt having a latent image distributed imagewise, produces a difference in diffusibility of the compound represented by $(\text{Dye-X})_n$-Y or releases Dye, the diffusibility of Dye released being different from that of the compound represented by $(Dye\text{-}X)_n\text{-}Y$; and n represents an integer of 1 or 2, when n=2, the Dye-X's may be the same or different.

Exemplary of the dye-providing substances having generaly formula [L I]there may be given dye developing reagents in the form of a hydroquinone-type developing reagent having a dye moiety attached thereto as disclosed in U.S. Pat. Nos. 3,134,764; 3,363,819; 3,597,200; 3,544,545; and 3,482,972. In addition, substances which release a diffusible dye through intramolecular nucleophilic substitution reaction are disclosed in U.S. Pat. No. 3,980,479, and substances which releases a diffusible dye through intramolecular rewind reaction of an isooxazolone ring are disclosed in Japanese Patent Application Kokai No. 49-111628. In the systems to which these substances are applied, a diffusible dye is released or diffused where no development has taken place and no dye is released or diffused where development has taken place.

Another system is proposed wherein the dye-providing substance is previously modified into an oxidant form having no dye releasing ability so that the modified substance may coexist with a reducing agent or precursor thereof. After development, the reducing agent which remains non-oxidized acts on the modified substance to reduce it, thereby releasing the diffusible bye. Typical examples of the dye-providing substances usable in such a system are described in Japanese Patent Application Kokai Nos. 53-110827, 54-130927, 56-164342, and 53-35533.

Also known are substances which release a diffusible dye where development has occurred. Couplers having a diffusible dye as an eliminatable group and thus releasing a diffusible dye through reaction with an oxidant of a developing reagent, known as DDR couplers, are described in British Pat. No. 1,330,524; Japanese Patent Publication No. 48-39165; U.S. Patent No. 3,443,940 and the like. In this case, Y in general formula [L I] represents a coupler residue.

The systems using these color developing agents have the serious problem that the resulting image can be contaminated with oxidation decomposition products of a developing agent. To overcome this problem, dye-releasing compounds have been proposed which themselves have reducing nature without the need for a developing agent. In this case, Y in general formula [L I] represents a reducing group capable of reducing an exposed silver halide and/or organic silver salt oxidizing agent. Typical examples of these compounds are dye-providing substances described in the following publications:

| | | |
|---|---|---|
| | U.S. Pat. Nos. | |
| 3,443,939, | 3,725,062, | 3,728,113, |
| 4,055,428, | 3,928,312, | 4,053,312, |
| | 4,336,322, | 4,500,626. |
| | Japanese Patent Application Kokai Nos. | |
| 59-65839, | 59-69839, | 58-116537, |
| 57-179840, | 53-3819, | 51-104343 |

Research Disclosure, RD 17465.

Representative examples of the dye-providing substances use herein are those compounds described in the above-incorporated U.S. Pat. No. 4,500,626, columns 22–44, most preferably the compounds identified therein as compounds (1)–(3), (10)–(13), (16)–(19), (28)–(30), (33)(35), (38)–(40), and (42)–(64). Also useful are the compounds described in Japanese Patent Application Kokai No. 61-124941.

In the practice of the present invention, the dyeproviding substances and other hydrophobic additives such as image formation accelerators as will be described later may be introduced into a layer of photosensitive material by any well-known methods, for example, the method described in U.S. Pat. No. 2,322,027. In this case, an organic solvent having a high boiling point as described in Japanese Patent Application Kokai Nos. 59-83154, 59-178451, 59-178452, 59-178453, 59-178454, 59-178455, and 59-178457 may be used, optionally in admixture with an organic solvent having a low boiling point in the range of from 50° C. to 160° C. The amount of the high boiling organic solvent used in the present invention is up to 10 grams, preferably up to 5 grams per gram of the dye-providing substance.

Further, it is possible to use a method for dispersion in polymers as described in Japanese Patent Publication No. 51-39853 and Japanese Patent Application Kokai No. 51-59943.

In case the substance is substantially insoluble in water, it may be finely divided into particles before being incorporated in the binder although the aforementioned methods may also be applicable. Moreover, various surfaceactive agents may be used when a hydrophobic substance like the dye-providing substance is dispersed in a hydrophilic colloid. For this purpose, the surface-active agents illustrated in Japanese Patent Application Kokai No. 59-157636, incorporated herein by reference, pages 37–38 may be used.

A reducing agent is contained in the photosensitive material according to the present invention. The reducing agents used herein include well-known reducing agents and the above-mentioned dye-providing substances having reducing ability. Also included are reducing agent precursors which themselves have no reducing nature, but exhibit reducing nature under the action of a nucleophilic agent or heat during the development process.

Examples of the reducing agents used herein include those reducing agents described in U.S. Pat. No. 4,500,626, columns 49–50, U.S. Pat. No. 4,483,914, columns 30–31, Japanese Patent Application Kokai No. 60-140335, pages 17–18, and Japanese Patent Application Kokai Nos. 60-128436, 60-128437, 60-128438, and 60-128439. Also useful are reducing agent precursors as disclosed in Japanese Patent Application Kokai Nos. 56-138736 and 57-40245, U.S. Pat. No. 4,330,617, and the like. Various combinations of developing agents as described in U.S. Pat. No. 3,039,869 may also be used.

In the practice of the present invention, the reducing agent may be added to amounts of from 0.01 to 20 mols, preferably from 0.1 to 100 mols per mol of silver.

An image formation promotor may also be used in the photosensitive material in the practice of the present invention. The image formation promotors have the functions of promoting such reaction as redox reaction of as silver salt-oxidizing agent with a reducing agent, formation of a dye from a dye-providing substance, decomposition of a dye or release of a mobile dye, and transfer of a dye from a photosensitive material layer to a dye-fixing layer. From their physical-chemistry, they may be classified into bases, base precursors, nucleophilic compounds, high-boiling organic solvents (oils), thermal solvents, surface-active agents, and compounds capable of interacting with silver or silver ion. It should be noted that these compounds generally have multiple functions and thus possess some of the abovementioned promoting effects combined. For further detail, reference is to be made to Japanese Patent Application No. 59-213978, pages 67–71.

Apart from the above-mentioned image formation accelerators, a number of other base-producing methods are known and any of the compounds used in these methods are useful as the base precursor. For example, copending U.S. Patent Application Ser. No. 890,442, filed July 30, 1986 and assigned to the same assignee as the present invention discloses a method for producing a base by mixing a difficulty soluble metal compoung with a compound (complexing compound) capable of forming a complex with the metal ion of the metal compound, and Japanese Patent Application No. 60-74702 discloses electrolytic base generation.

The former method is particularly effective. Examples of the difficulty soluble metal compounds include carbonates, hydroxides, and oxides of zinc, aluminum, calcium, and barium. The complexing compounds are detailed in, for example, A.E. Martell and R.M. Smith, "Critical Stability Constants", Vol. 4 and 5, Plenum Press. Some illustrative examples of the complexing compounds include salts of aminocarboxylic acids, imidinoacetic acids, pyridylcarboxylic acids, aminophosphoric acids, carboxylic acids (including mono-, di-, tri-, and tetracarboxylic acids with or without such as substituent as phosphone, hydroxy, oxo, ester, amide, alkoxy, mercapto, alkylthio, phosphino, etc.), hydroxamic acids, polyacrylic acids, and polyphosphoric acids with alkali metals, guanidines, amidines, and quaternary ammonium. It is advantageous to separately add the difficulty soluble metal compound and the complexing compound to the photosensitive material and the dye-fixing material, respectively, or vice verse.

In the practice of the present invention, a variety of development inhibitors may be used in the photosensitive element and/or dye-fixing element for the purpose of obtaining a consistent image irrespective of variations in treating temperature and time during heat development. By the development inhibitor is meant those compounds capable of, immediately after development has proceeded to an optimum extent, neutralizing or reacting with a base to reduce its concentration in the film to inhibit development, or those compounds capable of, immediately after optimum development, interacting with silver or silver salt to retard development. Illustrative examples are acid precursors capable of releasing acid upon heating, electrophilic compounds capable of substitution reaction with a coexisting base upon heating, nitrogenous hetrocyclic compounds, mercapto compounds and their precursors, and the like. Specific examples are disclosed in Japanese Patent Application Nos. 58-216928, 59-48305, 59-85834, and 59-85836.

Also useful are those compounds which release mercapto compounds upon heating, for example, those described in the following Japanese Patent Applications.

| | | |
|---|---|---|
| 59-176350 | 59-190173 | 59-246468 |
| 59-268926 | 60-22602 | 60-24665 |
| 60-26038 | 60-26039 | 60-29892 |

Further, in the present invention, it is possible to use a compound which activates development simultaneously with stabilizing the image. Particularly preferred compounds used herein are those described in U.S. Pat. No. 4,500,626, columns 51–52.

The photosensitive material used in the practice of the present invention may contain a toning agent if desired. Useful toning agents are those described in Japanese Patent Application No. 59-268926, pages 92–93.

The binders employed in the photosensitive material in the practice of the present invention may be hydrophilic. The typical hydrophilic binder is a transparent or translucent hydrophilic binder, examples of which include natural substances, for example, proteins such as gelatin, gelatin derivatives and cellulose derivatives and polysaccharides such as starch, gum arabic, etc.; and snythetic polymers, for example, water-soluble polyvinyl compounds such as polyvinyl pyrrolidone, acrylamide polymer, etc. Another example of the synthetic polymer compound is a dispersed vinyl compound in a latex form which is used for the purpose of increasing the dimensional stability of a photographic material. These binders may be used alone or in admixture. The binders may be coated in amounts of up to 20 grams per square meter, preferably up to 10 grams per square meter, and most preferably up to 7 grams per square meter.

The high-boiling organic solvent may be dispersed in the binder together with hydrophobic compounds, for example, a dye-providing substance such that the volume of the solvent is less than about 1 cc, preferably less than about 0.5 cc, and most preferably less than about 0.3 cc per gram of the binder.

Any of the layers of the heat-developable photosensitive material and the dye-fixing material according to the present invention, including photographic emulsion, dye-fixing and other layers, may contain inorganic or organic hardeners. Illustrative examples of the hardeners are those set forth in Japanese Patent Application No. 59-268926, pages 94–95, and Japanese Patent Application Kokai No. 59-157636, page 38. They may be used alone or in combination.

The support suitable for use in the photosensitive material and optional dye-fixing material according to the present invention must withstand the processing temperature. Exemplary of ordinary supports there may be given not only glass, paper, polymer film, metal and analogues, but also those described as supports in Japanese Patent Application No. 59-268926, pages 95–96.

If desired, a filter dye or absorbing material may be contained as described in Japanese Patent Application No. 59-268926, pages 97–98 and U.S. Pat. No. 4,500,626, col. 55, lines 41–52.

Sharpness can be further improved by providing an anti-halation layer even when the dye-providing substances are colored in yellow, magenta, and cyan. The anti-halation layer is essential particularly when the photosensitive material has an infrared sensitive layer.

The anti-halation layer may be formed using a well-known dyestuff or pigment. To provide an anti-halation layer for an infrared sensitive layer, an infrared absorber or carbon black is advantageously used. The use of carbon black is particularly advantageously whereupon a base may be colored therewith or a carbon black-containing layer may be separately provided. The practical manner of providing an anti-halation layer may accord with Japanese Patent Application No. 61-18963.

In order to provide a wide range of color within the chromaticity diagram using the three primary colors, yellow, magenta and cyan, the photosensitive elements used in the present invention should include at least three silver halide emulsion layers having sensitivity in different spectra. Typical combinations of at least three photosensitive silver halide emulsion layers having sensitivity in different spectra are described in Japanese Patent Application Kokai 59-180550. One photosensitive emulsion layer having sensitivity in a certain spectrum may be divided into two or more sublayers, depending on the sensitivy of emulsion, if desired.

The photosensitive materials used in the practice of the present invention may further contain any of various additives well known for use in heat-developable photosensitive materials and possess in addition to the photosensitive layers, any layers including a protective layer, intermediate layer, antistatic layer, electroconductive layer, antihalation layer, release layer, and matte agent layer. Exemplary of the additives there may be given plasticizers, matte agents, sharpness improving dyes, anti-halation dyes, sensitizing dyes, surface-active agents, brighteners, UV absorbers, sliding agents, antioxidants, anti-fading agents, etc. as described in Research Disclosure, Vol. 170, June 1978, No. 17029. More specifically, the protective layer or coat (PC) usually contains an organic or inorganic matte agent for adherence prevention. The protective layer may futher contain a mordant, a UV absorber, etc. Each of the protective and intermediate layers may be comprised of two or more layers.

The intermediate layer may contain a reducing agent for preventing discoloration or color mixing, a UV absorber, and a white pigment such as titanium dioxide. The white pigment may be added not only to the intermediate layer, but also to the emulsion layers for the purpose of increasing sensitivity.

The photograhpic element according to the present invention may be comprised of a photosensitive element which forms or releases a dye through heat development and optionally, a dye-fixing element which fixes the dye.

Particularly, systems of forming an image through diffusion transfer of a dye need the photosensitive and dye-fixing elements as requisite elements. They are generally classified into two typical forms, one form having photosensitive and dye-fixing layers separately applied on two separate supports and another form having both photosensitive and dye-fixing layers applied on a common support. With respect to the relation of the photosensitive element nd the dye-fixing element to one another, to the support, and to a white reflective layer, reference may be made to the descriptions of Japanese Patent Application No. 59-268926, pages 58–59 and U.S. Pat. No. 4,500,626, col. 57.

A typical system having both photosensitive and dye-fixing elements applied on a common support is one wherein the photosensitive element need not be peeled from the image-receiving element after formation of a transfer image. In this case, a photosensitive layer, a dye-fixing layer, and a white reflective layer are laminated on a transparent or opaque support. The preferred arrangements are transparent support/photosensitive layer/white reflective layer/dye-fixing layer and transparent support/dye-fixing layer/white reflective layer/photosensitive layer, to name a few.

Another typical form having both photosensitive and dye-fixing elements applied on a common support is one wherein a release layer is applied at a proper location such that the photosensitive element may be entirely or partially separated from the dye-fixing element, as disclosed in Japanese Patent Application Kokai No. 56-67840, Canadian Pat. No. 674,082, and U.S. Pat. No. 3,730,718.

The photosensitive element and/or dye-fixing element according to the present invention may have an electroconductive heating element layer serving as heating means for heat development or diffusion transfer of dye. Such a transparent or opaque heating element may be provided in the form of a resistance heating element terials which can be used in these methods are described in Japanese Patent Application No. 59-151815.

The dye-fixing element preferably used in the present invention has at least one layer containing a mordant. Where the dye-fixing layer is positioned at the surface, a protective layer may be provided thereon if necessary. The dye-fixing element, particularly with respect to its layer arrangement, binder, additives, and location of a mordant-containing layer, is described in Japanese Patent Application No. 59-268926, pages 62–63 and the patent specifications cited therein, which are incorporated herein by reference.

The dye-fixing element may optionally be provided with any auxiliary layers, for example, a release layer, matte agent layer, and anti-curling layer, in addition to the above-mentioned layers. One or more of these layers may contain a base and/or base precursor for promoting dye transfer, hydrophilic thermal solvent, plasticizer, anti-fading agent, UV absorber, sliding agent, matte agent, antioxidant, dispersed vinyl compound for increasing dimensional stability, surface-active agent, brightener, etc. Illustrative examples of these additives are described in Japanese Patent Application No. 59-209563, pages 101, 120.

The binders in the above-mentioned layers are preferably hydrophilic, and a typical binder is a transparent or translucent hydrophilic colloid. Illustrative examples are those previously enumerated for the photosensitive material.

The image-receiving layer based in the present invention is a dye-fixing layer which is commonly used in a heat-developable color photosensitive material and contains a mordant selected from commonly used ones. Preferred mordants are polymeric mordants. The polymeric mordants include polymers containing a tertiary amino group, polymers having a nitrogenous heterocyclic moiety, and polymers containing a quaternary cationic group. Examples are described in Japanese Patent Application No. 59-268926, pages 98–100 and U.S. Pat. No. 4,500,626, columns 57–60.

In the practice of the present invention, the heat-developable photosensitive, protective, intermediate, undercoat, backcoat, dye-fixing, and other layers may be applied by any conventional coating methods, typically, the method described in U.S. Pat. No. 4,500,626, columns 55–56.

The light source for image exposure to record an image in the heat-developable light-sensitive element may be any radiation including visible light. In general, light sources used in ordinary color printing may be used as set forth in Japanese Patent Application No. 59-268926, page 100 and U.S. Pat. No. 4,500,626, col. 56.

The heating temperature used in the heat development step generally ranges from about 50° C. to about 250° C., preferably from about 80° C. to about 180° C. Where a dye transfer step is carried out after completion of a heat development step, the heating temperature used in the transfer step may range from room temperature to the temperature used in the heat development to enable dye transfer, more preferably from 50° C. to a temperature which is about 10° C. lower than the temperature used in the heat development. Heating means used in the development and/or transfer step include heat blocks, irons, heat rollers, and heating elements using carbon and titanium white, but not limited thereto.

In one preferred mode of the image forming process, a heat-developed photosensitive material is heated in the presence of a minor amount of solvent, typically water to concurrently or sequentially conduct development and transfer. In this mode, the above-mentioned image formation promotor may be previously contained in the dye-fixing material and/or photosensitive material. The mode of concurrently or sequentially carrying out development and transfer prefers a heating temperature in the range from 50° C. up to the boiling point of the solvent, for example, from 50° C. to 100° C. for water solvent.

A solvent may also be used in order to allow the mobile dye to migrate to the dye-fixing layer.

Examples of the solvents used to provide for promotion of development and/or migration of a mobile dye to the dyefixing layer are water and aqueous basis solutions containing inorganic alkali metal salts and organic bases, with the bases being selected from those previously described in conjunction with the image formation promotor. Also useful are low-boiling solvents and mixtures of low-boiling solvents and water or aqueous basic solutions. Such additives as surface-active agent, anti-fogging agent, and difficulty soluble metal salt-complexing agent combination may be contained in the solvent.

These solvents may be applied to the dye-fixing material and/or photosensitive material. The amount of solvent used is as small as up to the weight of solvent corresponding to the maximum swollen volume of the overall coatings, more specifically up to the weight of solvent corresponding to the maximum swollen volume of the overall coatings minus the weight of the overall coatings. the preferred amount of water or similar solvent used is from 2 to 35 gram/m$^2$, more preferably from 3 to 25 gram/m$^2$.

The solvent, typically water is applied between a photosensitive layer of a heat-developable photosensitive material and a dye-fixing layer of a dye-fixing material in order to promote formation of an image and/or migration of a dye, and it may be previously incorporated in either the photosensitive and/or dye-fixing layer. A suitable method for providing the solvent to the photosensitive or dye-fixing layer is described in Japanese Patent Application No. 59-268926, pages 101–102, for example.

To promote dye transfer, the photosensitive material or dye-fixing material may contain therein a hydrophilic thermal solvent which is solid at an ambient temperature, but melts at elevated temperatures to serve as solvent. The hydrophilic thermal solvent may be incorporated in the photosensitive element and/or the dye-fixing element. Although the solvent can be incorporated into any of the emulsion layer, intermediate layer, protective layer, and dye-fixing layer, it is preferred to incorporate it into the dye-fixing layer and/or layers adjacent thereto. Examples of the hydrophilic thermal solvents include ureas, pyridines, amides, sulfonamides, imides, alcohols, oximes and other heterocyclic compounds.

Heating means used during the transfer step in the practice of the present invention may be any of the means described in Japanese Patent Application No. 59-268926, pages 102–103. It is also possible to provide the dye-fixing material with a layer of electroconductive material such as graphite, carbon black, and metal whereby electric current is conducted to the conductive layer to directly heat the material.

The pressure under which the photosensitive and dye-fixing materials are in firm contact and application of such pressure may be in accord with the method described in Japanese Patent Application No. 59-268926, pages 103–104.

The heat-developable photosensitive material according to the present invention, comprising a silver halide emulsion at least a portion of which is an emulsion of silver halide grains having a distinct double-layered structure in the grain interior and an average grain size of at least 0.3 μm, and at least one compound selected from the compounds of general formulas (I) and (II) has the advantages of (i) a high sensitivity with a high maximum image density (Dmax) and a low fog (Dmin), (ii) less sensitization or desensitization by pressure as compared with emulsions having a uniform intragranular halogen distribution, (ii) little change of sensitivity with temperature and humidity upon exposure, and (iv) little latent image feeding and a good raw stock shelf life.

EXAMPLES

In order that those skilled in the art may better understand how the present invention may be practiced, the following examples are given by way of illustration and not by way of limitation.

EXAMPLE 1

A dispersion of a magenta dye-providing substance in gelatin containing a compound falling within the scope of the present invention was prepared as follows.

A homogeneous solution was prepared by weighing 5 grams of magenta dye-providing substance (A) having the formula shown below, 0.2 grams of compound (2) according to the present invention, 0.2 grams of antifoggant (C) having the formula shown below, 0.5 grams of succinic acid-2-ethylhexyl ester sodium sulfonate surfactant, and 10 grams of triisononyl phosphate, adding them to 30 ml of ethyl acetate, and heating at about 60° C. The solution was mixed with 100 grams of a 10 wt % lime-treated gelatin solution by agitation, and the mixture was dispersed with a homogenizer for 10 minutes at 10,000 rpm. This dispersion is called magenta dye-providing substance dispersion MD1.

For comparison purposes, another magenta dye-providing substance dispersion MD2 was prepared by the same procedure as magenta dye-providing substance dispersion MD1 except that compound (2) was excluded. A further magenta dye-providing substance dispersion MD3 was prepared by the same procedure as magenta dye-providing substance dispersion MD1 except that compound (2) was replaced by comparative compound (X) shown below.

Magenta dye-providing substance (A)

-continued

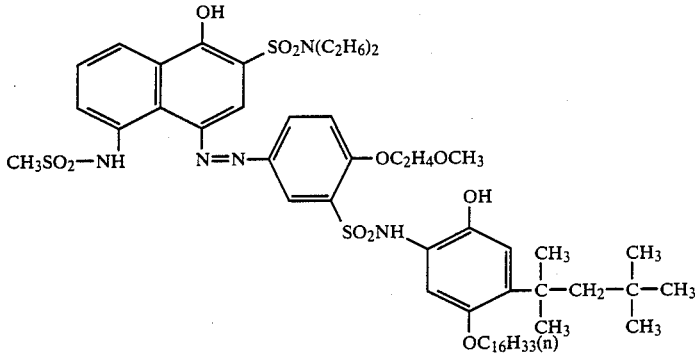

Antifoggant (C)

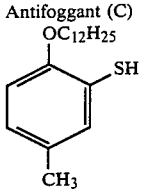

Comparative Compound (X)

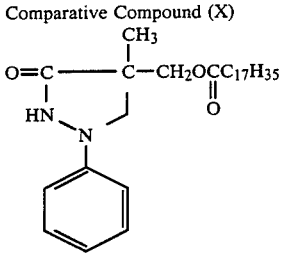

Core/shell type emulsions having an irregular intragranular halogen distribution according to the present invention and an emulsion having a uniform intragranular halogen distribution as a control were prepared as follows.

In 800 ml of water were dissolved 20 grams of gelatin, 4 grams of sodium chloride, and 0.015 grams of a compound of the formula:

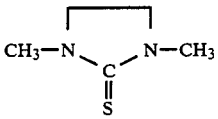

The gelatin solution was kept at 65° C. and thoroughly stirred. Solutions I and II shown in the following Formulation Table were added to the gelatin solution over a period of 30 minutes. The resulting solution was allowed to stand for 10 minutes before solutions III and IV shown in the following Formulation Table were added over a period of 30 minutes. Immediately after addition of solutions III and IV, the resulting solution was combined with a dye solution of 0.24 grams of sensitizing dye (A) having the formula shown below in 120 ml of methanol and 120 ml of water and then allowed to stand for 20 minutes. After water rinsing and desalting, 25 grams of gelatin and 100 ml of water were added to the solution which was adjusted to pH 6.4 and pAg 7.7.

Sensitizing dye (A):

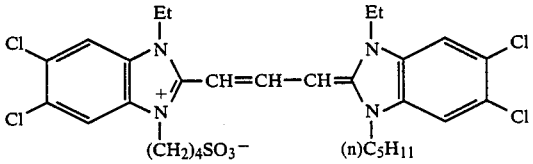

The resulting five emulsions E1 to E5 each were a cubic monodispersed emulsion having a grain size of about 0.5 μm. While being kept at 60° C., emulsions E1 to E5 were processed for optimum chemical sensitization by adding 1.3 mg of triethylthiourea and 100 mg of 4-hydroxy-6-methyl-1,3,3a,7-tetrazaindene. There was yielded 650 grams of each emulsion.

Emulsions E1 to E5 was analyzed by X-ray diffractometry. The X-ray diffraction patterns of emulsions E1 to E5 given as diffraction intensity versus diffraction angle are illustrated in FIG. 1. It is seen from FIG. 1 that emulsion E4 is outside the scope of the present invention. Emulsions E1, E2, E3 and E5 were further determined by EPMA to insure that they fall within the scope of the present invention.

Formulation Table

| | Solution* | | | | | |
|---|---|---|---|---|---|---|
| | I | II | | III | IV | |
| | $AgNO_3$ (g) | KBr (g) | NaCl (g) | $AgNO_3$ (g) | KBr (g) | NaCl (g) |
| Emulsion** | | | | | | |
| E1 | 50 | 22.9 | 5.9 | 50 | 28 | 3.6 |
| E2 | 50 | 17.6 | 8.3 | 50 | 28 | 3.6 |
| E3 | 50 | 28 | 3.6 | 50 | 22.9 | 5.9 |
| E4 | 50 | 22.9 | 5.9 | 50 | 22.9 | 5.9 |
| E5 | 50 | 17.6 | 8.3 | 50 | 22.9 | 5.9 |

*Solutions I to IV each had a total volume of 300 ml.
**Emulsion E4 is of non-core/shell type while the remaining emulsions E1-E3 and E5 are of core/shell type.

Using the above-prepared dispersions and emulsions, photosensitive material Nos. 1-10 and 101 (see Table 2) having the formulation shown in Table 1 were prepared. Figures in parentheses deginate a coating weight expressed in milligram per square meter.

TABLE 1

Gelatin layer
Gelatin (800 mg/m$^2$)
Hardener*3 (50 mg/m$^2$)
Silica*4 (100 mg/m$^2$)
Zinc hydroxide*5 (300 mg/m$^2$)
Emulsion E1-E5 (450 mg/m$^2$ of Ag)
Magenta dye-providing substance A (600 mg/m$^2$)

TABLE 1-continued

| |
|---|
| Photosensitive layer |
| Gelatin (1500 mg/m$^2$) |
| High-boiling solvent*1 (1200 mg/m$^2$) |
| Surfactant*2 (150 mg/m$^2$) |
| Antifoggant C (24 mg/m$^2$) |
| Compound (2) of invention (24 mg/m$^2$ for MD1 and 0 mg/m$^2$ for MD2 and MD3) |
| Comparative compound X (0 mg/m$^2$ for MD1 and MD2 and 24 mg/m$^2$ for MD3) |
| Support: Polyethylene terephthalate of 100 μm thick |
| Backcoat layer |
| Carbon black (440 mg/m$^2$) |
| Polyester (300 mg/m$^2$) |
| Polyvinyl chloride (300 mg/m$^2$) |

*1High-boiling solvent: (iso-$C_9H_{19}O)_3P{=}O$

*2Surfactant: 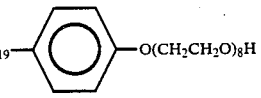

*3Hardener: 1,2-bis(vinylsulfonylacetamide)ethane
*4Silica: size 4 μm
*5Zinc hydroxide: size 0.2 μm Next, the preparation of a dye-fixing material will be described.

In 1300 ml of water were dissolved 63 grams of gelatin, 130 grams of a mordant having the structure shown below, and 80 grams of potassium picolinate. The solution was coated onto a paper substrate laminated with polyethylene, thereby forming a mordant layer having a uniform wet thickness of 45 μm, which was then dried.

Mordant:

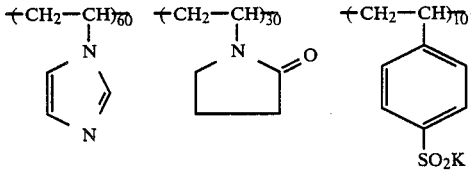

A solution of 35 grams of gelatin and 1.85 grams of 1,2-bis(vinylsulfonylacetamide)ethane in 800 ml of water was then coated on the layer to a wet film thickness of 17 μm. Drying resulted in a dye-fixing material.

Photosensitive material Nos. 1–10 and 101 were exposed for 1/100 second at 2000 lux through a neutral grey wedge having continuously varying density. Water was applied by means of a wire bar in an amount of 7 ml per square meter to the emulsion surface of the exposed photosensitive material, which was superimposed on the dye-fixing material such that their effective surfaces faced one another. After heating for 25 seconds through heat rollers at such a temperature that the temperature of the wet film reached 90° C., the dyefixing material was peeled from the photosensitive material. The dye-fixing material then bore thereon a clear magenta image. The maximum density (Dmax), minimum density (Dmin), and relative sensitivity (RS) of the color image of each photosensitive material were measured. The results are shown in Table 2. The sensitivity was determined at a level of the minimum density (Dmin) plus 0.3, and calculated based on a sensitivity of 100 for photosensitive material No. 10.

TABLE 2

| Photo-sensitive material | Emul-sion | Com-pound | Dmin | Dmax | RS | Remarks |
|---|---|---|---|---|---|---|
| 1 | E1 | (2) | 0.18 | 2.55 | 110 | Invention |
| 2 | E1 | none | 0.30 | 2.25 | 110 | Comparison |
| 3 | E2 | (2) | 0.17 | 2.51 | 115 | Invention |
| 4 | E2 | none | 0.27 | 2.23 | 115 | Comparison |
| 5 | E3 | (2) | 0.17 | 2.47 | 120 | Invention |
| 6 | E3 | none | 0.26 | 2.22 | 120 | Comparison |
| 7 | E5 | (2) | 0.17 | 2.52 | 115 | Invention |
| 8 | E5 | none | 0.27 | 2.23 | 115 | Comparison |
| 9 | E4 | (2) | 0.17 | 2.25 | 98 | Comparison |
| 10 | E4 | none | 0.20 | 2.15 | 100 | Comparison |
| 101 | E1 | X | 0.33 | 2.54 | 110 | Comparison |

As seen from Table 2, the compound according to the present invention exerts a more development accelerating effect on a core/shell type emulsion, the development accelerating effect being demonstrated by increases of Dmax and sensitivity. The compound according to the present invention can suppress the fog, which would otherwise increase with the use of a core/shell type emulsion, without sacrificing the high sensitivity advantage. As compared with a conventional well-known development accelerator, comparative compound (X), the compound according to the present invention can increase Dmax and sensitivity while suppressing fog.

In addition, photosensitive material Nos. 1, 3, 5, 7 and 9 were determined for pressure effect (desensitization). The materials were manipulated with a round tip of a probe under a predetermined load before developed. The degree of color development of an unexposed area, that is, pressure mark was determined by visual observation. Photosensitive material Nos. 1, 3, 5, and 7 were found to exhibit less pressure marks than comparative material No. 9.

EXAMPLE 2

Photosensitive material Nos. 11 to 20 were prepared by the same procedure as used for photosensitive material No. 5 of Example 1 except that compound (2) was replaced by compounds (5), (6), (12), (13), (44), (21), (37), and (39) according to the present invention. These photosensitive material Nos. 11–20 were exposed and heat developed by the same procedure as in Example 1. The results are shown in Table 3.

TABLE 3

| Photo-sensitive material | Emul-sion | Com-pound | Dmin | Dmax | RS | Remarks |
|---|---|---|---|---|---|---|
| 11 | E3 | (5) | 0.18 | 2.47 | 120 | Invention |
| 12 | E3 | (6) | 0.17 | 2.46 | 120 | Invention |
| 13 | E3 | (12) | 0.18 | 2.46 | 120 | Invention |
| 14 | E3 | (13) | 0.17 | 2.45 | 120 | Invention |
| 15 | E3 | (44) | 0.17 | 2.46 | 120 | Invention |
| 16 | E3 | (21) | 0.18 | 2.39 | 118 | Invention |
| 17 | E3 | (37) | 0.19 | 2.38 | 117 | Invention |
| 18 | E3 | (39) | 0.18 | 2.38 | 117 | Invention |
| 19 | E3 | (X-1) | 0.20 | 2.24 | 108 | Comparison |
| 20 | E3 | (X-2) | 0.21 | 2.25 | 110 | Comparison |
| 6 | E3 | none | 0.26 | 2.22 | 120 | Comparison |
| 10 | E4 | none | 0.20 | 2.15 | 100 | Comparison |

Compounds (X-1) and (X-2) in Table 3 are the compounds described in Japanese Patent Application Kokai No. 60-198540 and having the following formulae.

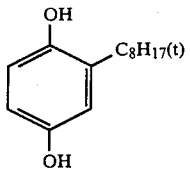

(X-1)

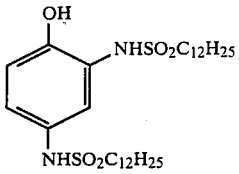

(X-2)

As seen from Table 3, the objects of the present invention can be accomplished with widely varying compounds falling in the entire scope of the general formulae defined herein. Better development acceleration is achieved particularly when Y in the formulae forms a naphthalene nucleus. It was observed that compounds (X-1) and (X-2) described in Japanese Patent Application Kokai No. 60-198540 have a less development acceleration effect on a core/shell type emulsion compared with the compounds of the present invention.

EXAMPLE 3

The emulsion preparing procedure of Example 1 was repeated except that the time of adding solutions I and II was controlled, obtaining monodispersed cubic emulsions E6 to E13 having a grain size varying from 0.25 μm to 0.7 μm. The emulsions E6 to E13 were processed for optimum sulfur sensitization with triethylthioruea and 4-hydroxy-6-methyl1,3,3a,7-tetrazaindene. There was yielded 650 grams of each emulsion.

It was determined by X-ray diffractometry and EPMA in the same manner as in Example 1 whether or not an emulsion belonged to the core/shell type. Emulsions E6, E7, E8 and E9 were found to be of the core/shell type and emulsions E10, E11, E12 and E13 found to be a conventional emulsion having a uniform halogen distribution. It should be noted that emulsion E6 does not fall in the scope of the present invention because of its grain size.

| | Grain size (μ) | Formulation Table Solution* I $AgNO_3$ | II KBr | II NaCl | III $AgNO_3$ | IV KBr | IV NaCl |
|---|---|---|---|---|---|---|---|
| Emulsion** | | | | | | | |
| E6 | 0.25 | 50 | 17.6 | 8.3 | 50 | 28 | 3.6 |

-continued

| | Grain size (μ) | Formulation Table Solution* I $AgNO_3$ | II KBr | II NaCl | III $AgNO_3$ | IV KBr | IV NaCl |
|---|---|---|---|---|---|---|---|
| E7 | 0.35 | 50 | 17.6 | 8.3 | 50 | 28 | 3.6 |
| E8 | 0.45 | 50 | 17.6 | 8.3 | 50 | 28 | 3.6 |
| E9 | 0.7 | 50 | 17.6 | 8.3 | 50 | 28 | 3.6 |
| E10 | 0.25 | 50 | 22.9 | 5.9 | 50 | 22.9 | 5.9 |
| E11 | 0.35 | 50 | 22.9 | 5.9 | 50 | 22.9 | 5.9 |
| E12 | 0.45 | 50 | 22.9 | 5.9 | 50 | 22.9 | 5.9 |
| E13 | 0.7 | 50 | 22.9 | 5.9 | 50 | 22.9 | 5.9 |

*Solutions I to IV each had a total volume of 300 ml. Figures under the headings of $AgNO_3$, KBr, and NaCl are the amounts of the compounds expressed in gram.
**The underline indicates comparison.

Photosensitive materials as shown in Table 4 were prepared by the same procedure as photosensitive material No. 1 of Example 1 except that emulsions E6 to E13 mentioned above were used.

The subsequent processing was the same as in Example 1, with the results shown in Table 4.

It is to be noted that the sensitivity (relative sensitivity RS) of a photosensitive material having a core/shell type emulsion was calculated based on a sensitivity of 100 for a non-core/shell type emulsion having the same grain size.

TABLE 4

| Photosensitive material | Emulsion Name | Emulsion Type* | Av. grain size (μ) | Dmin | Dmax | RS | Remarks |
|---|---|---|---|---|---|---|---|
| 21 | E6 | C/S | 0.25 | 0.13 | 2.52 | 100 | Comparison |
| 22 | E10 | conv. | 0.25 | 0.13 | 2.52 | 100 | Comparison |
| 23 | E7 | C/S | 0.35 | 0.15 | 2.50 | 110 | Invention |
| 24 | E11 | conv. | 0.35 | 0.15 | 2.25 | 100 | Comparison |
| 25 | E8 | C/S | 0.45 | 0.17 | 2.45 | 118 | Invention |
| 26 | E12 | conv. | 0.45 | 0.17 | 2.10 | 100 | Comparison |
| 27 | E9 | C/S | 0.7 | 0.18 | 2.40 | 121 | Invention |
| 28 | E13 | conv. | 0.7 | 0.18 | 2.10 | 100 | Comparison |

*C/S: core/shell type
conv.: conventional type

As seen from Table 4, the compounds of the present invention exert a more outstanding Dmax and sensitivity increasing effect on core/shell type emulsions having an average grains size of 0.3 μm or more.

EXAMPLE 4

Organic silver salts (1) and (2) were prepared as follows.

Organic silver salt (1)

A silver benzotriazole emulsion was prepared by dissolving 28 grams of gelatin and 13.2 grams of benzotriazole in 300ml of water. The resulting solution was agitated at 40° C. A solution of 17 grams of silver nitrate in 100 ml of water was added to the solution over a period of 2 minutes.

The resulting silver benzotriazole emulsion was adjusted to such pH that an excess salt precipitated, and the excess salt was filtered off. The emulsion was then adjusted to pH 6.30, obtaining a silver benzotriazole emulsion in a yield of 400 grams. Organic silver salt (2)

In 1000 ml of an aqueous 0.1% sodium hydroxide solution and 200 ml of ethanol were dissolved 20 grams of gelatin and 5.9 grams of 4-acetylaminophenylpropiolic acid. The resulting solution was agitated at 40° C. A solution of 4.5 grams of silver nitrate in 200 ml of water was added to the solution over a period of 5 minutes.

The resulting dispersion was adjusted to such pH that an excess salt precipitated, and the excess salt was filtered off. The dispersion was then adjusted to pH 6.3, obtaining a dispersion of organic silver salt (2) in a yield of 300 grams.

Dispersions of dye-providing substances in gelatin were prepared. A dispersion of a magenta dye-providing substance was magenta dye-providing substance dispersion MD1 of Example 1.

A yellow dye-providing substance dispersion designated YD4 was prepared by the same procedure as the magenta dye-providing substance dispersion MD1 except that a yellow dye-providing substance (D) of the formula shown below was used.

A cyan dye-providing substance dispersion designated CD5 was prepared by the same procedure as the magenta dye-providing substance dispersion MD1 except that a cyan dye-providing substance (E) of the formula shown below was used.

Yellow dye-providing substance (D)

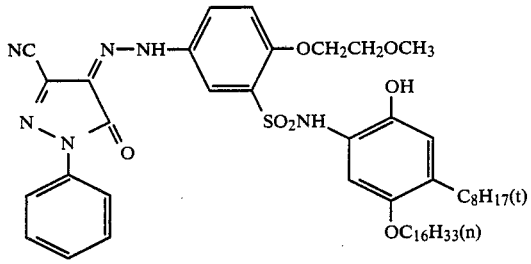

Cyan dye-providing substance (E)

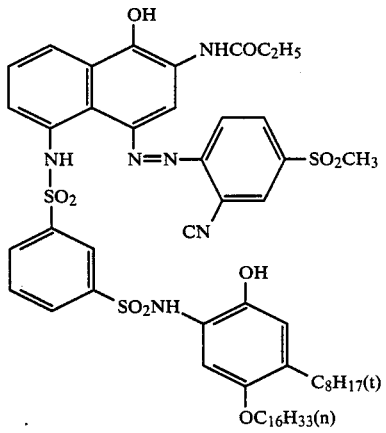

Preparation of emulsions used is described below. It was determined by X-ray diffractory and EPMA whether or not an emulsion prepared was an emulsion having an irregular halogen distribution, that is, core/-shell type emulsion.

First layer emulsion

A cubic monodispersed dispersion having a uniform halogen distribution was prepared by dissolving 20 grams of gelatin, 2 grams of sodium chloride, and 0.015 grams of a compound of the formula:

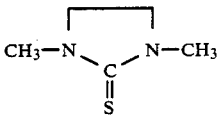

in 800 ml of water. The gelatin solution was kept at 70° C. and thoroughly stirred. Solutions I and II shown below were added to the gelatin solution over a period of 30 minutes. The resulting solution was allowed to stand for 5 minutes before solutions III and IV shown below were added over a period of 30 minutes. After wash rinsing and desalting, 25 grams of gelatin and 100 ml of water were added to the solution which was adjusted to pH 6.4 and pAg 8.0.

| Composition of Solutions I-VI | | | | |
|---|---|---|---|---|
| Solution | I | II | III | IV |
| Total volume (ml) | 300 | 300 | 300 | 300 |
| $AgNO_3$ (g) | 50 | — | 50 | — |
| KBr (g) | — | 28 | — | 28 |
| NaCl (g) | — | 3.6 | — | 3.6 |

The resulting emulsion was determined to be a cubic monodispersed emulsion having a uniform halogen distribution and a grain size of about 0.45 μm.

The emulsion was processed for optimum chemical sensitization with triethylthiourea and 4-hydroxy-6-methyl-1,3,3a,7-tetrazaindene. There was yielded 650 grams of an emulsion designated E14.

An emulsion having an irregular halogen distribution in the grain interior was prepared. The procedure of emulsion E14 was repeated except that the halogen content of solution II was changed to 23 grams of KBr and 6 grams of NaCl, obtaining a monodispersed cubic silver chlorobromide emulsion having an irregular halogen distribution. This emulsion is designated E15.

Third layer emulsion

In 600 ml of water were dissolved 20 grams of gelatin, 0,75 grams of KBr and 0.3 grams of $HO(CH_2)_2S(CH_2)_2S(CH_2)_2OH$. To the gelatin solution kept at 68° C., solutions I and II shown below were simultaneously added at an equal flow rate over a period of 20 minutes. The solution was allowed to stand for 10 minutes. Solutions III and IV were then added by the controlled double jet process over a period of 30 minutes while maintaining the pAg at 8.4. Immediately after the addition, a dye solution of 0.14 grams of sensitizing dye (B) having the formula shown below in 70 ml of methanol was added.

Sensitizing dye (B):

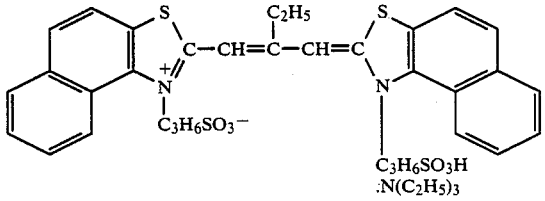

The resulting solution was allowed to stand for 20 minutes. After water rinsing and desalting, 25 grams of gelatin and 100 ml of water were added to the solution which was adjusted to pH 6.4 and pAg 8.4.

| Solution | Composition of Solutions I–VI | | | |
|---|---|---|---|---|
| | I | II | III | IV |
| Total volume | 160 ml | 160 ml | 450 ml | 450 ml |
| $AgNO_3$ (g) | 20 | — | 80 | — |
| KBr (g) | — | 14 | — | 61 |
| KI (g) | — | 0.2 | — | 0.8 |

The resulting emulsion was determined to be a monodispersed octahedral silver iodobromide emulsion having a uniform iodine distribution and a grain size of about 0.55 μm. The emulsion was processed for optimum chemical sensitization with sodium thiosulfate at 60° C. There was yielded 650 grams of an emulsion designated E16.

An octahedral emulsion having an irregular halogen distribution in the grain interior was prepared. The procedure of emulsion E16 was repeated except that the amount of $HO(CH_2)_2S(CH_2)_2S(CH_2)_2OH$ in the gelatin solution was increased to 0.38 grams and the compositions of solutions I to IV were changed as shown below, obtaining a monodispersed octahedral silver iodobromide emulsion having an irregular iodine distribution and a grain size of about 0.55 μm. This emulsion is designated E17.

| Solution | Composition of Solutions I–VI | | | |
|---|---|---|---|---|
| | I | II | III | IV |
| Total volume | 160 ml | 160 ml | 450 ml | 450 ml |
| $AgNO_3$ (g) | 20 | — | 80 | — |
| KBr (g) | — | 14 | — | 62 |
| KI (g) | — | 1 | — | — |

Fifth layer emulsion

A cubic monodispersed dispersion having a uniform halogen distribution was prepared by dissolving 20 grams of gelatin, 4 grams of sodium chloride, and 0.015 grams of a compound of the formula:

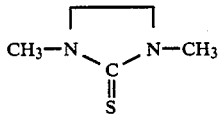

in 800 ml of water. The gelatin solution was kept at 65° C. and thoroughly stirred. Solutions I and II shown below were added to the gelatin solution over a period of 30 minutes. The resulting solution was allowed to stand for 10 minutes before solutions II and IV shown below were added over a period of 30 minutes. Immediately after the addition, a dye solution of 0.24 grams of sensitizing dye (A) having the formula shown below in 120 ml of methanol and 120 ml of water was added.

Sensitizing dye (A):

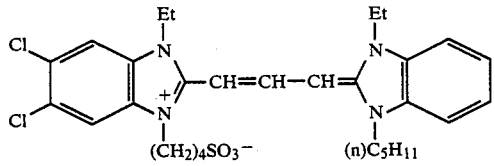

The resulting solution was allowed to stand for 10 minutes. A potassium bromide solution of 2 grams of KBr in 20 ml of water was added to the solution, which was allowed to stand for a further 10 minutes. After water rinsing and desalting, 25 grams of gelatin and 100 ml of water were added to the solution which was adjusted to pH 6.4 and pAg 8.2.

| Solution | Composition of Solutions I–VI | | | |
|---|---|---|---|---|
| | I | II | III | IV |
| Total volume (ml) | 300 | 300 | 300 | 300 |
| $AgNO_3$ (g) | 50 | — | 50 | — |
| KBr (g) | — | 22.9 | — | 22.9 |
| NaCl (g) | — | 5.9 | — | 5.9 |

The resulting emulsion was determined to be a cubic monodispersed emulsion having a uniform halogen distribution and a grain size of about 0.5 μm, with the grain surface converted to KBr.

The emulsion was processed for optimum chemical sensitization with triethylthiourea and 4-hydroxy-6-methyl-1,3,3a,7-tetrazaindene. There was yielded 650 grams of an emulsion designated E18.

An emulsion having an irregular halogen distribution in the grain interior was prepared. The procedure of emulsion E18 was repeated except that the halogen content of solution II was changed to 17.6 grams of KBr and 8.3 grams of NaCl and the halogen content of solution IV was changed to 28 grams of KBr and 3.6 grams of NaCl, obtaining a monodispersed cubic silver chlorobromide emulsion having an irregular halogen distribution, with the grain surface converted to KBr. This emulsion is designated E19.

Using the emulsions, dye-providing substance dispersions, organic silver salts all prepared above, photosensitive material Nos. 29 and 30 having a multi-layer structure were prepared as reported in Table 5. Figures in parentheses in Table 5 designate a coating weight expressed in milligram per square meter.

Combinations of the emulsions used in the photosensitive materials are shown below.

| | Photosensitive material No. | |
|---|---|---|
| | 29 (comparison) | 30 (Invention) |
| Fifth layer emulsion (green-sensitive) | E18 | E19 |
| Third layer emulsion (red-sensitive) | E16 | E17 |
| First layer emulsion (infrared-sensitive) | E14 | E15 |

TABLE 5

Sixth layer
Gelatin (800 mg/m$^2$)
Hardener*3 (100 mg/m$^2$)
Silica*4 (100 mg/m$^2$)
Zinc hydroxide*5 (300 mg/m$^2$)
Fifth layer
Emulsion E18 or E19 (400 mg/m$^2$ of Ag)
Organic silver salt (2) (100 mg/m$^2$ of Ag)
Yellow dye-providing substance D (400 mg/m$^2$)
Gelatin (1000 mg/m$^2$)
High-boiling solvent*1 (800 mg/m$^2$)
Compound (2) of invention (16 mg/m$^2$)
Antifoggant C (16 mg/m$^2$)
Surfactant*2 (100 mg/m$^2$)
Fourth layer
Gelatin (1000 mg/m$^2$)
Zinc hydroxide*5 (300 mg/m$^2$)

TABLE 5-continued

Third layer

Emulsion E16 of E17 (300 mg/m$^2$ of Ag)
Organic silver salt (1) (10 mg/m$^2$ of Ag)
Organic silver salt (2) (100 mg/m$^2$ of Ag)
Magenta dye-providing substance A (400 mg/m$^2$)
Gelatin (1000 mg/m$^2$)
High-boiling solvent*1 (800 mg/m$^2$)
Compound (2) of invention (16 mg/m$^2$)
Antifoggant C (16 mg/m$^2$)
Surfactant*2 (100 mg/m$^2$)

Second layer

Gelatin (800 mg/m$^2$)
Zinc hydroxide*5 (300 mg/m$^2$)

First layer

Emulsion E14 of E15 (300 mg/m$^2$ of Ag)
Sensitizing dye*6 ($2\times10^{-7}$ mol/m$^2$)
Organic silver salt (1) (100 mg/m$^2$ of Ag)
Cyan dye-producing substance E (300 mg/m$^2$)
Gelatin (1000 mg/m$^2$)
High-boiling solvent*1 (600 mg/m$^2$)
Surfactant*2 (100 mg/m$^2$)
Compound (2) of invention (12 mg/m$^2$)
Antifoggant C (12 mg/m$^2$)

Support: Polyethylene terephthalate of 100 μm thick

Backcoat layer

Carbon black (440 mg/m$^2$)
Polyester (300 mg/m$^2$)
Polyvinyl chloride (300 mg/m$^2$)

*1High-boiling solvent: $(iso\text{-}C_9H_{19}O)_3P{=}O$

*2Surfactant: 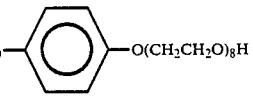

*3Hardener: 1,2-bis(vinylsulfonylacetamide)ethane
*4Silica: size 4 μm
*5Zinc hydroxide: size 0.2 μm
*6Sensitizing dye:

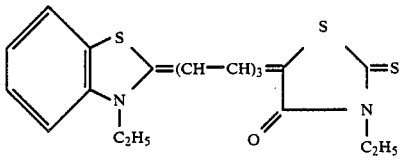

The thus obtained photosensitive material Nos. 29 and 30 were exposed for 1/20 second at 2000 lux under a tungsten lamp through three color separation filters G, R, and IR having a continuously varying density. Water was applied by means of a wire bar in an amount of 15 ml per square meter to the emulsion surface of the thus exposed photosensitive material, which was superimposed on the same dye-fixing material as used in Example 1 such that their effective surfaces contacted one another. After heating for 25 seconds through heat rollers at such a temperature that the temperature of the wet film reached 90° C., the dye-fixing material was peeled from the photosensitive material. The dye-fixing material then bore thereon clear images of yellow (Y), magenta (M), and cyan (C) corresponding to the three color separation filters B, G, and R. The maximum density (Dmax) and minimum density (Dmin) of the respective color images were measured by means of a Macbeth (RD-519) reflection densitometer.

The results are shown in Table 6. The sensitivity of a photosensitive material was determined at a level of the minimum density (Dmin) plus 0.3 and calculated based on a sensitivity of 100 for the corresponding comparative emulsion (No. 29).

TABLE 6

| | Photosensitive material No. | |
|---|---|---|
| | 29 (Comparison) | 30 (Invention) |
| Yellow | | |
| Relative sensitivity | 100 | 105 |
| Dmin | 0.16 | 0.16 |
| Magenta | | |
| Relative sensitivity | 100 | 118 |
| Dmin | 0.15 | 0.15 |
| Cyan | | |
| Relative sensitivity | 100 | 121 |
| Dmin | 0.13 | 0.13 |

It is evident that the use of a core/shell type emulsion according to the present invention results in a photosensitive material having a very high sensitivity.

It was found that when the photosensitive materials were exposed for a very short time of $10^{-4}$ second under a xenon flash lamp, the photosensitive material according to the present invention was more sensitive like the results of Table 6.

Additionally, photosensitive material Nos. 29 and 30 were exposed for $10^{-4}$ second under a xenon flash lamp through three color separation filters G, R, and IR in atmospheres of 10° C./RH30% and 35° C./RH70%, and then subjected to substantially the same heat development and transfer treatments as above. Sensitivity to exposure in the atmospheres of 10° C./RH30% and 35° C./RH70% was compared between photosensitive material Nos. 29 and 30. For all the yellow, magenta and cyan layers, photosensitive material No. 30 of the present invention exhibited a sensitivity change of approximately one-half of that of the comparative material No. 29.

Photosensitive material Nos. 29 and 30 was compared for sensitivity by exposing the materials for $10^{-4}$ second under a xenon flash lamp in a 25° C./RH60% atmosphere and carrying out development and transfer processes with a lapse of time of 10 seconds and 120 seconds after exposure. No sensitivity change as observed for either of photosensitive material Nos. 29 and 30 irrespective of some change in the lapse of time from exposure to development/transfer.

EXAMPLE 5

Preparation of emulsions used is described below. It was determined by X-ray diffractometry and EPMA whether or not an emulsion prepared was an emulsion having an irregular halogen distribution, that is, core/-shell type emulsion.

First layer emulsion

A cubic monodispersed dispersion having a uniform halogen distribution was prepared by dissolving 20 grams of gelatin, 0.75 grams of KBr, and 0.45 grams of $HO(CH_2)_2S\text{-}(CH_2)_2S(CH_2)_2OH$ in 600 ml of water. The gelatin solution was kept at 68° C. and thoroughly stirred. Solutions I and II shown below were added to the gelatin solution over a period of 20 minutes. The resulting solution was allowed to stand for 10 minutes. Then solutions III and IV shown below were added over a period of 30 minutes while controlling the pAg at 7.5. Immediately after the addition, a dye solution of 0.14 grams of sensitizing dye (B) used in Example 4 in 70 ml of methanol was added to the solution, which was allowed to stand for 20 minutes. After water rinsing and desalting, 25 grams of gelatin and 100 ml of water were added to the solution which was adjusted to pH 6.4 and pAg 8.2.

| Solution | Composition of Solutions I-VI I | II | III | IV |
|---|---|---|---|---|
| Total volume (ml) | 160 | 160 | 450 | 450 |
| $AgNO_3$ (g) | 20 | — | 80 | — |
| KBr (g) | — | 14 | — | 56 |
| KI (g) | — | 1.2 | — | 5.2 |

The resulting emulsion was determined to be a monodispersed cubic silver iodobromide emulsion having a uniform iodine distribution and a grain size of about 0.5 μm. The emulsion was processed for optimum gold-sulfur chemical sensitization with sodium thiosulfate and chloroauric acid. There was yielded 650 grams of an emulsion designted E20.

An emulsion having an irregular halogen distribution in the grain interior was prepared. The procedure of emulsion E20 was repeated except that the halogen content of solution IV was changed to 60 grams of KBr and 0 gram of KI, obtaining a monodispersed cubic silver iodobromide emulsion having an irregular halogen distribution. This emulsion is designated E21.

Third layer emulsion

In 600 ml of water were dissolved 20 grams of gelatin, 0.75 grams of KBr and 0.45 grams of $HO(CH_2)_2S(CH_2)_2S—(CH_2)_2OH$. The gelatin solution was kept at 68° C. while thoroughly stirred. Solutions I and II shown below were added to the gelatin solution over a period of 20 minutes. Immediately after the addition, a dye solution of 0.2 grams of sensitizing dye (C) having the formula shown below in 150 ml of methanol was added.

Sensitizing dye (C):

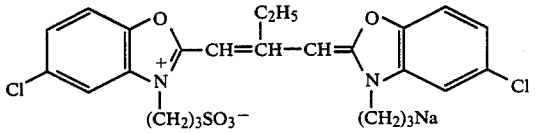

The resulting solution was allowed to stand for 10 minutes. Solutions III and IV were then added over a period of 30 minutes while maintaining the pAg at 7.5. At the end of addition of solutions III and IV, the combined solution was allowed to stand for a further 10 minutes and then cooled. After water rinsing and desalting, 25 grams of gelatin and 100 ml of water were added to the solution which was adjusted to pH 6.4 and pAg 8.2.

| Solution | Composition of Solutions I-VI I | II | III | IV |
|---|---|---|---|---|
| Total volume | 160 ml | 160 ml | 450 ml | 450 ml |
| $AgNO_3$ (g) | 20 | — | 80 | — |
| KBr (g) | — | 14 | — | 56 |
| KI (g) | — | 1.2 | — | 5.2 |

The resulting emulsion was determined to be a monodispersed cubic silver iodobromide emulsion having a uniform iodine distribution and a grain size of about 0.5 μm. The emulsion was processed for optimum gold-sulfur chemical sensitization with sodium thiosulfate and chloroauric acid at 60° C. There was yielded 650 grams of an emulsion designated E22.

An emulsion having an intragranular irregular halogen distribution was prepared. The procedure of emulsion E22 was repeated except that the halogen content of solution IV was changed to 6 grams of KBr and 0 gram of KI, obtaining a monodispersed cubic silver iodobromide emulsion having an irregular iodine distribution. This emulsion is designated E23.

Fifth layer emulsion

A monodispersed dispersion having a uniform halogen distribution was prepared by dissolving 30 grams of gelatin, 3 grams of potassium bromide, and 1.5 grams of $HO(CH_2)_2S—(CH_2)_2S(CH_2)_2OH$ in 600 ml of water. The gelatin solution was kept at 75° C. and thoroughly stirred. Solutions I and II shown below were added to the gelain solution over a period of 20 minutes. The resulting solution was allowed to stand for 10 minutes before solutions III and IV shown below were added over a period of 30 minutes. Immediately after the addition, a dye solution of 0.1 grams of sensitizing dye (D) having the formula shown below in 100 ml of methanol was added.

Sensitizing dye (D):

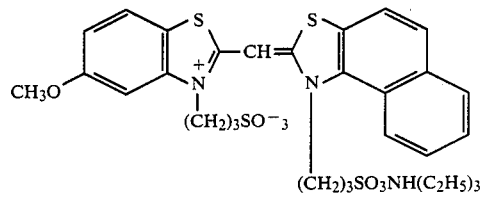

The resulting solution was shown to stand for 10 minutes. After water rinsing and desalting, 25 grams of gelatin and 100 ml of water were added to the solution which was adjusted to pH 6.4 and pAg 8.7.

| Solution | Composition of Solutions I-VI I | II | III | IV |
|---|---|---|---|---|
| Total volume (ml) | 320 | 220 | 480 | 350 |
| $AgNO_3$ (g) | 20 | — | 80 | — |
| KBr (g) | — | 12 | — | 57 |
| KI (g) | — | 3 | — | 12 |

The resulting emulsion was determined to be a monodispersed octahedral silver iodobromide emulsion having a uniform iodine distribution and a grain size of about 0.85 μm. The emulsion was processed for optimum chemical sensitization with sodium thiosulfate and 4-hydroxy-6-methyl-1,3,3a,7-tetrazaindene at 65° C. There was yielded 650 grams of an emulsion designated E24.

An emulsion having an intragranular irregular halogen distribution was prepared. The procedure of emulsion E24 was repeated except that the halogen content of solution IV was changed to 6.5 grams of KBr and 0.4 grams of KI, obtaining a monodispersed octahedral silver iodobromide emulsion having an irregular iodine distribution. This emulsion is designated E25.

Photosensitive material Nos. 31 and 32 were prepared by repeating the same procedure as the multi-layer structured photosensitive materials shown in Table 5 except that the sensitizing dye*6 was removed from the first layer and emulsions E14 to E19 were replaced by emulsions E20 to E25 as shown below.

Combinations of the emulsions used in the photosensitive materials are shown below.

| | Photosensitive material No. | |
|---|---|---|
| | 31 (comparison) | 32 (Invention) |
| Fifth layer emulsion (blue-sensitive) | E24 | E25 |
| Third layer emulsion (green-sensitive) | E22 | E23 |
| First layer emulsion (red-sensitive) | E20 | E21 |

The thus obtained photosensitive material Nos. 31 and 32 were exposed for 1/20 second at 2000 lux under a tungsten lamp through three color separation filters B, G, and R having a continuously varying density. At the end of exposure, the same procedure as in Example 3 was repeated. The results are shown in Table 7.

TABLE 7

| | Photosensitive material No. | |
|---|---|---|
| | 31 (Comparison) | 32 (Invention) |
| Yellow | | |
| Relative sensitivity | 100 | 125 |
| Dmin | 0.18 | 0.18 |
| Magenta | | |
| Relative sensitivity | 100 | 119 |
| Dmin | 0.16 | 0.16 |
| Cyan | | |
| Relative sensitivity | 100 | 114 |
| Dmin | 0.14 | 0.14 |

Measurement of relative sensitivity is the same as in Example 4.

It is evident that the core/shell type emulsion photosensitive material according to the present invention has a very high sensitivity.

It was found that when the photosensitive materials were exposed for a very short time of $10^{-4}$ second under a xenon flash lamp, the photosensitive material according to the present invention was more sensitive.

Additionally, photosensitive material Nos. 31 and 32 were exposed for 1/20 second at 2000 lux under a xenon flash lamp through three color separation filers B, G, and R and then shelf aged for 20 days at room temperature. The materials were then subjected to heat development and transfer treatments to determine the degree of latent image fading. For all the yellow, magenta, and cyan layers, photosensitive material No. 32 according to the present invention exhibited a less degree of latent image fading than comparative material No. 31.

EXAMPLE 6

Preparation of emulsions used is described below. It was determined by X-ray diffractometry and EPMA whether or not an emulsion prepared was an emulsion having an irregular halogen distribution, that is, core/-shell type emulsion.

First layer emulsion

A monodispersed cubic emulsion having a uniform halogen distribution designated E26 was prepared by repeating the procedure of preparing emulsion E14 in Example 4 except that a dye solution of 0.14 grams of sensitizing dye (B) in 70 ml of methanol as used in Example 4 was added at the end of addition of solutions III and IV, and the resulting solution was allowed to stand for 10 minutes and then cooled, rinsed with water, and desalted.

A monodispersed cubic silver chlorobromide emulsion having an irregular halogen distribution designated E27 was prepared by repeating the the procedure of preparing emulsion E15 in Example 4 except that the same sensitizing dye solution as in emulsion E26 was added at the end of addition of solutions III and IV.

Third layer emulsion

A monodispersed cubic emulsion having a uniform halogen distribution designated E28 was prepared by repeating the procedure of preparing emulsion E14 in Example 4 except that a dye solution of 0.2 grams of sensitizing dye (C) in 150 ml of methanol as used in Example 5 was added at the end of addition of solutions III and IV, and the resulting solution was allowed to stand for 10 minutes and then cooled, rinsed with water, and desalted.

A monodispersed cubic silver chlorobromide emulsion having an irregular halogen distribution designated E29 was prepared by repeating the the procedure of preparing dye solution as in emulsion E28 was added at the end of addition of solutions III and IV.

Fifth layer emulsion

A monodispersed cubic emulsion having a uniform halogen distribution designated E30 was prepared by repeating the procedure of preparing emulsion E14 in Example 4 except that a dye solution of 0.15 grams of sensitizing dye (D) in 150 ml of methanol as used in Example 5 was added at the end of addition of solutions III and IV, and the resulting solution was allowed to stand for 10 minutes and then cooled, rinsed with water, and desalted.

A monodispersed cubic silver chlorobromide emulsion having an irregular halogen distribution designated E31 was prepared by repeating the the procedure of preparing emulsion E15 in Example 4 except that a potassium bromide solution of 1 gram of KBr in 10 ml of water was added just at the end of addition of solutions I and II, and the same sensitizing dye solution as in emulsion E30 was added at the end of addition of solutions III and IV.

Photosensitive material Nos. 33 and 34 having the same construction as in Example 5 were prepared using the above-prepared emulsions in the following combinations.

| | Photosensitive material No. | |
|---|---|---|
| | 33 (comparison) | 34 (Invention) |
| Fifth layer emulsion (blue-sensitive) | E30 | E31 |
| Third layer emulsion (green-sensitive) | E28 | E29 |
| First layer emulsion (red-sensitive) | E26 | E27 |

The thus obtained photosensitive material Nos. 33 and 34 were processed in the same manner as in Example 5. The results are shown in Table 8.

TABLE 8

| | Photosensitive material No. | |
|---|---|---|
| | 33 (Comparison) | 34 (Invention) |
| Yellow | | |
| Relative sensitivity | 100 | 121 |
| Dmin | 0.16 | 0.16 |

TABLE 8-continued

| | Photosensitive material No. | |
|---|---|---|
| | 33 (Comparison) | 34 (Invention) |
| Magenta | | |
| Relative sensitivity | 100 | 106 |
| Dmin | 0.15 | 0.15 |
| Cyan | | |
| Relative sensitivity | 100 | 112 |
| Dmin | 0.13 | 0.13 |

Measurement of relative sensitivity is the same as in Example 4.

It is evident that the core/shell type emulsion photosensitive material according to the present invention has a very high sensitivity.

It was found that when the photosensitive materials were exposed for a very short time of $10^{-4}$ second under a xenon flash lamp, the photosensitive material according to the present invention were more sensitive.

Additionally, photosensitive material Nos. 33 and 34 were shelf aged at a temperature of 40° C. and a relative humidity of 50% and then measured for sensitivity by sensitometry. The photosensitive material according to the present invention experienced a less sensitivity drop than the comparative material.

While the preferred embodiments of the present invention have been described, it is to be understood that modifications and changes will occur to those skilled in the art without departing from the spirit of the invention. The scope of the invention is therefore to be determined solely by the appended claims.

We claim:

1. In a heat-developable photosensitive material comprising at least a silver halide emulsion, a reducing agent for the silver halide emulsion, and a binder on a support, the improvement wherein at least a portion of said silver halide emulsion is an emulsion of silver halide grains having a distinct double-layered structure in the grain interior and an average grain size of at least 0.3 μm, and the photosensitive material further comprises at least one member selected from the group consisting of compounds having the general formulas (I) and (II):

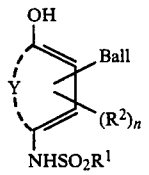

(I)

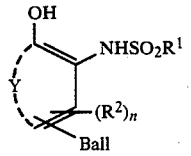

(II)

wherein Ball contains at least 8 carbon atoms and is selected from the group consisting of an alkyl radical, an acylamino radical, an acyl radical, an acyloxy radical, an alkoxy radical, an alkylthio radical, and radicals as represented by the general formulae (A) and (B), (A) $-(L)_m-CONR^3-Ball$ (B) $-SO_2NR^3Ball$ wherein $R^3$ is hydrogen, an alkyl radical, a cycloalkyl radical or an aryl radical, L is an alkylene radical, a phenylene radical, or a divalent arylthio radical, m is equal to 0 or 1, Ball represents an organic ballast radical capable of rendering the compounds of these formulae non-diffusible, all radicals represented by Ball being substituted or unsubstituted with the proviso that Ball may be absent when $R^1$ is a non-diffusible radical;

Y represents a group of carbon atoms necessary to complete a bezene or naphthalene nucleus;

$R^1$ is selected from the group consisting of a substituted or unsubstituted alkyl, cycloalkyl, aralkyl, aryl, amino, and heterocyclic radical;

$R^2$ is selected from the group consisting of hydrogen, a halogen atom, a substituted or unsubstituted alkyl, cycloalkyl, aralkyl, aryl, heterocyclic, alkoxy, aryloxy, acyl, alkyloxycarbonyl, arylosycarbonyl, carbamoyl, sulfamoyl, alkylsulfonyl, arylsulfonyl, acylamino, alkylthio, and arylthio radical; and n is an integer having a value of 0 to 5;

wherein when n is 2 to 5, a corresponding plurality of $R^2$ may be the same or different and may be combined together to form a ring, and when Y represents a group of carbon atoms necesary to complete a naphthalene nucleus, Ball and $R^2$ may be attached to either of the thus formed rings.

2. The heat-developable photosensitive material of claim 1 wherein the silver halide grains have an average grain size of 0.3 μm to 3 μm.

3. The heat-developable photosensitive material of claim 1 wherein $R^1$ is selected from the group consisting of substituted or unsubstituted alkyl radicals having 1 to 30 carbon atoms, substituted or unsubstituted cycloalkyl radicals having 5 to 30 carbon atoms, substituted or unsubstituted aralkyl radicals having 7 to 30 carbon atoms, substituted or unsubstituted aryl radicals having 6 to 30 carbon atoms, substitued or unsubstituted amino radicals having 0 to 30 carbon atoms, and substituted or unsubstituted heterocyclic radicals.

4. The heat-developable photosensitive material of claim 1 wherein $R^2$ is selected from the group consisting of hydrogen, halogen atoms, substituted or unsubstituted alkyl radicals having 1 to 20 carbon atoms, substituted or unsubstituted cycloalkyl radicals having 5 to 20 carbon atoms, substituted or unsubstituted aralkyl radicals having 7 to 20 carbon atoms, substituted or unsubstituted aryl radicals having 6 to 20 carbon atoms, substituted or unsubstituted heterocyclic radicals, substituted or unsubstituted alkoxy radicals having 1 to 20 carbon atoms, substituted or unsubstituted aryloxy radicals having 6 to 20 carbon atoms, substituted or unsubstituted acyl radicals having 1 to 20 carbon atoms, substituted or unsubstituted alkyloxycarbonyl radicals having 1 to 20 carbon atoms, substituted or unsubstituted aryloxycarbonyl radicals having 6 to 20 carbon atoms, substituted or unsubstituted carbamoyl radicals having 1 to 20 carbon atoms, substituted or unsubstituted sulfamoyl radicals having 1 to 20 carbon atoms, substituted or unsubstituted alkylsulfonyl radicals having 1 to 20 carbon atoms, substituted or unsubstituted arylsulfonyl radicals having 6 to 20 carbon atoms, substituted or unsubstituted acylamino radicals having 2 to 20 carbon atoms, substituted or unsubstituted alkylthio radicals having 1 to 20 carbon atoms, and substituted or unsubstituted arylthio radicals having 6 to 30 carbon atoms.

5. The heat-developable photosensitive material of claim 1 wherein the compound of formula (I) or (II) is present in an amount of 0.0005 to 20 mols per mol of the silver.

6. The heat-developable photosensitive material of claim 1 wherein the compound of formula (I) or (II) is present in an amount of 0.001 to 4 mols per mol of the silver.

7. The heat-developable photosensitive material of claim 1 which further comprises a dye-providing substance.

8. The heat-developable photosensitive material of claim 7 wherein said dye-providing substance has the general formula [L I] :

$$(\text{Dye-X})_n\text{—Y} \qquad [\text{L I}]$$

wherein Dye represents a dye group, a temporarily wavelength shortened dye group or a dye precursor group; X represents a single bond or a connecting linkage; and Y represents a group which, in correspondence or counter-correspondence to photosensitive silver salt having a latent image distributed imagewise, produces a difference in diffusibility of the compound represented by $(\text{Dye-X})_n$—Y or releases Dye, the diffusibility of Dye released being different from that of the compound represented by $(\text{Dye-X})_n$—Y; and n represents an integer of 1 or 2, when n is equal to 2, the Dye-X's may be the same or different.

9. The heat-dfevelopable photosensitive material of claim 1 wherein said reducing agent is a dye-providing substance possessing reducing nature in itself and having the general formula [L I]:

$$(\text{Dye-X})_n\text{—Y} \ [\text{L I}]$$

wherein Dye represents a dye group, a temporarily wavelength shortened dye group or a dye precursor group; X represents a single bond or a connecting linkage; and Y represents a reducing group capable of reducing an exposed silver halide and/or organic silver salt oxidizing agent; and n represents an integer of 1 or 2, when is equal to 2, the Dye-X's may be the same or different.

10. The heat-developable photosensitive material of claim 1 which further comprises a dye-providing substance possessing reducing nature in itself and having the general formula [L I]:

$$(\text{Dye-X})_n\text{—Y} \ [\text{L I}]$$

wherein Dye represents a dye group, a temporarily wavelength shortened dye group or a dye precursor group; X represents a single bond or a connecting linkage; and Y represents a reducing group capable of reducing an exposed silver halide and/or organic silver salt oxidizing agent; and n represents an integer of 1 or 2, when n is equal to 2, the Dye-X's may be the same or different.

* * * * *